US007314015B1

(12) United States Patent
Obahi et al.

(10) Patent No.: US 7,314,015 B1
(45) Date of Patent: Jan. 1, 2008

(54) EXPRESS DOCKING SYSTEM AND METHOD OF USE

(76) Inventors: Hassan Obahi, 172 High Meadow Dr., West Springfield, MA (US) 01089; John J. Pavlovich, 61 E. Gooseberry Rd., West Springfield, MA (US) 01089

( * ) Notice: Subject to any disclaimer, the term of this patent is extended or adjusted under 35 U.S.C. 154(b) by 24 days.

(21) Appl. No.: 11/379,368

(22) Filed: Apr. 19, 2006

Related U.S. Application Data

(60) Provisional application No. 60/594,567, filed on Apr. 19, 2005.

(51) Int. Cl.
*B63B 21/00* (2006.01)

(52) U.S. Cl. ..... 114/231; 114/230.16

(58) Field of Classification Search ..... 114/231, 114/230.1, 252, 249, 230.15, 230.16, 230.18; 213/150; 244/172.4; 292/11, 36, 18, 24, 292/53

See application file for complete search history.

(56) References Cited

U.S. PATENT DOCUMENTS 2,404,329 A * 7/1946 Wallace ..... 114/252
3,060,885 A * 10/1962 Nolf ..... 114/230.16
3,177,839 A * 4/1965 Nolf ..... 114/230.18
3,461,829 A * 8/1969 Mosvold ..... 114/246

* cited by examiner

*Primary Examiner*—Ed Swinehart
(74) *Attorney, Agent, or Firm*—Deborah A Basile; Karen K Chadwell

(57) ABSTRACT

An express docking system and its method of use, wherein the system comprises: an engaging rod assembly comprising an engaging rod subassembly attachable to a boating vessel, wherein the engaging rod subassembly comprises an engaging rod in communication with a main frame; a mooring assembly comprising: a mounting subassembly attached to a dock; a carriage subassembly slidably engaged with the mounting subassembly; an actuating subassembly mounted to the carriage subassembly; and a jaw subassembly comprising a first jaw opposite to a second jaw; wherein the engaging rod is disposable between the first and second jaws.

17 Claims, 27 Drawing Sheets

Figure 31
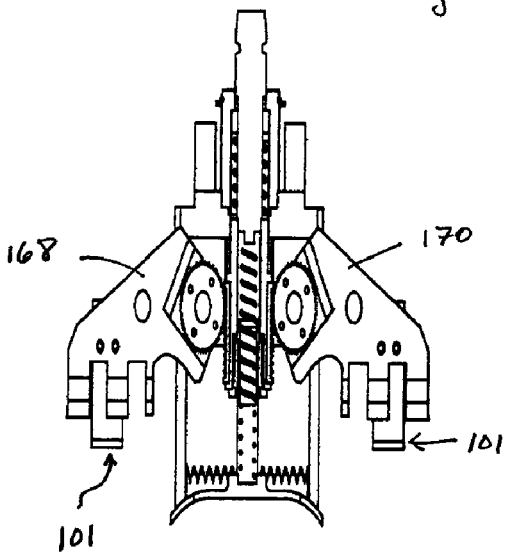
Figure 32
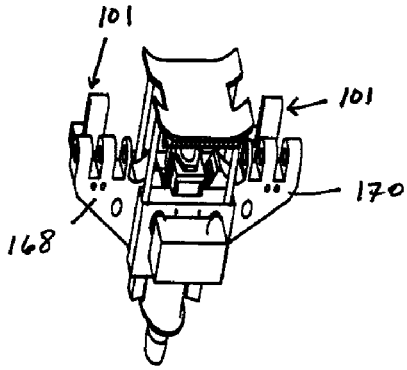
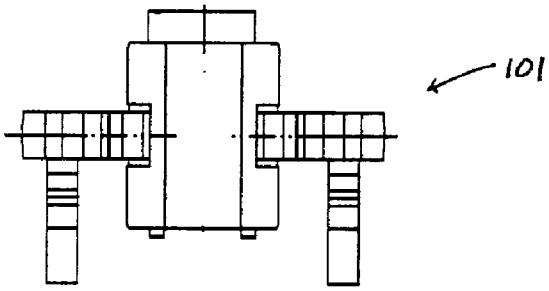
Figure 33

EXPRESS DOCKING SYSTEM AND METHOD OF USE

CROSS REFERENCE TO RELATED APPLICATIONS

This application claims the benefit of U.S. Provisional Application No. 60/594,567 filed on Apr. 19, 2005.

BACKGROUND OF THE INVENTION

1. Field of the Invention

This invention relates to a system for mooring a vessel to a dock. More specifically, the invention disclosed herein relates to a system for engaging and disengaging a boating vessel to a dock by mechanical means.

2. Background of the Invention

Current docking procedures direct the captain of the boating vessel to "push" the boating vessel against either a set of fenders placed on a floating dock, or to push the boating vessel directly to the structure of the floating dock using 80 percent or more of engine throttle. Generally, during the mooring of the boating vessel, the captain will approach the dock, most of the time from a variety of angles and then, by expertly maneuvering the boating vessel, the captain aligns the boating vessel with the dock. Upon mooring, the captain throttles the boating vessel forward at 80 percent or more of engine power; passengers then disembark and/or embark the boating vessel. After the passengers have embarked and/or disembarked, the captain sets the engine in reverse, moving away from the dock, and continues on the boating vessel's navigational route. Accordingly, present docking and undocking procedures consume excess fuel, emitting excessive and harmful fuel emissions into the environment.

Furthermore, currently, boating vessels are not secured to the floating dock, thereby, causing a significant degree of movement between the boating vessel and the dock, which can render the loading and unloading of passengers difficult and unsafe. Accordingly, what is needed is a system that can safely and reliably dock a variety of shaped, sized, and types of boating vessels to a dock.

SUMMARY OF THE INVENTION

The problems discussed above are eliminated or greatly reduced by an express docking system comprising an engaging rod assembly comprising an engaging rod subassembly attachable to a boating vessel, wherein the engaging rod subassembly comprises an engaging rod in communication with a main frame; a mooring assembly comprising: a jaw subassembly comprising a set of two jaws; and a signal indicator assembly comprising an mounting subassembly attached to a dock; a carriage subassembly slidably engaged with the mounting subassembly; an actuating subassembly mounted to the carriage subassembly; and a jaw subassembly comprising a first jaw opposite to a second jaw; wherein the engaging rod is disposable between the first and second jaws. The invention is further characterized by a method for engaging and disengaging a boating vessel from the express docking system. It is intended that the advantages and objects of the present invention that become apparent or obvious from the detailed description or illustrations contained herein are within the scope of the present invention.

BRIEF DESCRIPTION OF THE DRAWINGS

FIG. 29 is a schematic illustrating a side view of the signaling assembly depicted in FIGS. 19-21;

FIGS. 31-33 are schematics illustrating exemplary torsion subassemblies.

DETAILED DESCRIPTION OF THE INVENTION

Figure 1:
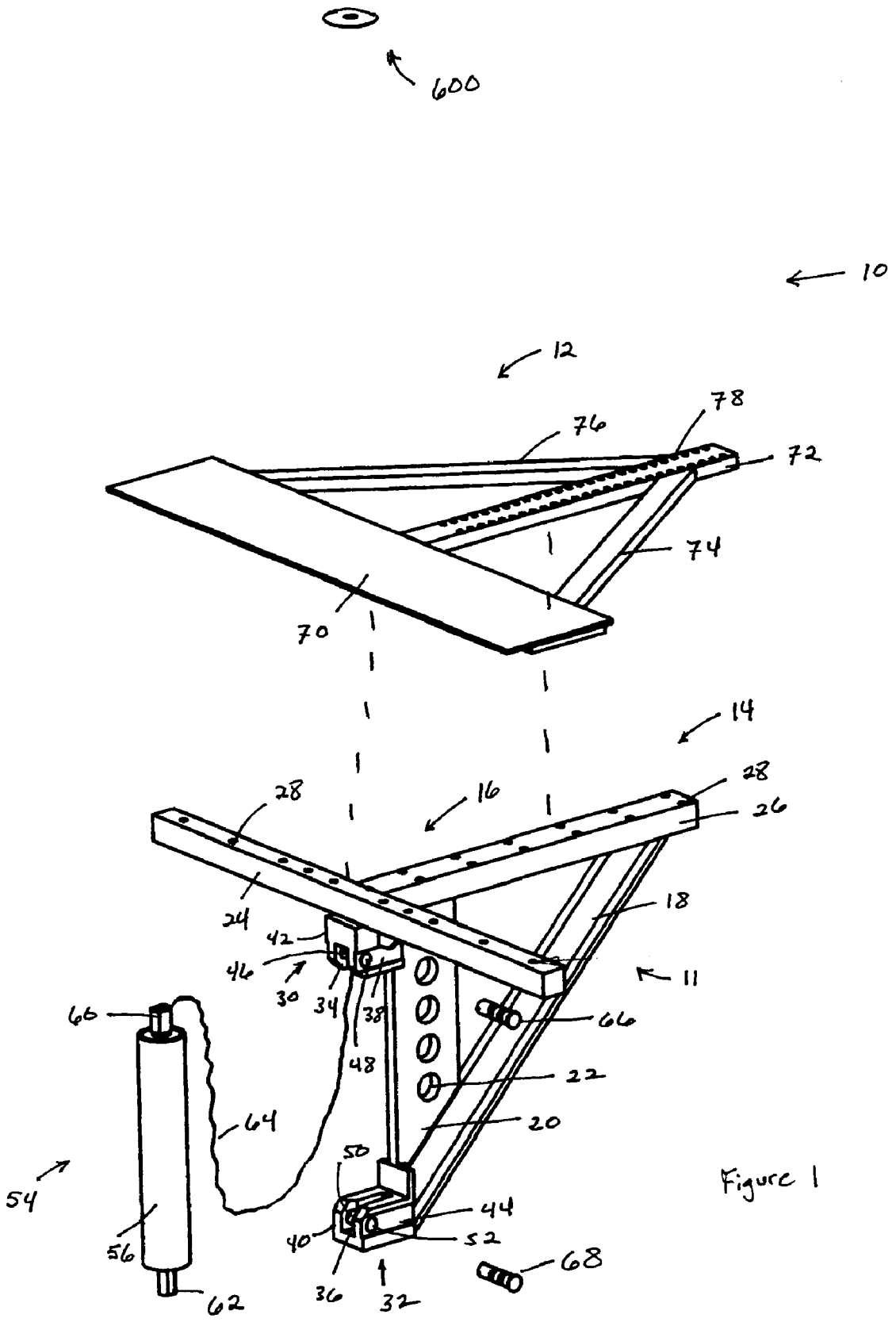
FIG. 1 is a schematic illustrating an exemplary engaging rod assembly.
Figure 2:
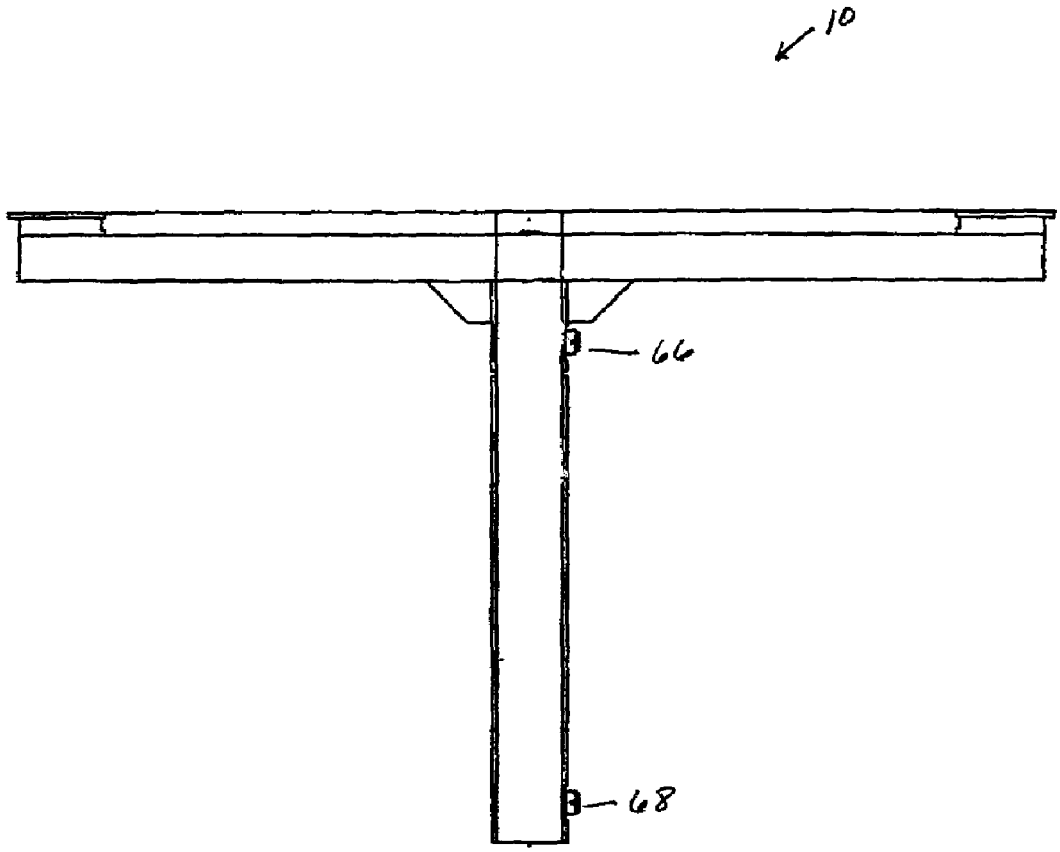
FIG. 2 is a schematic illustrating a profile view of an exemplary engaging rod assembly.
Figure 3:
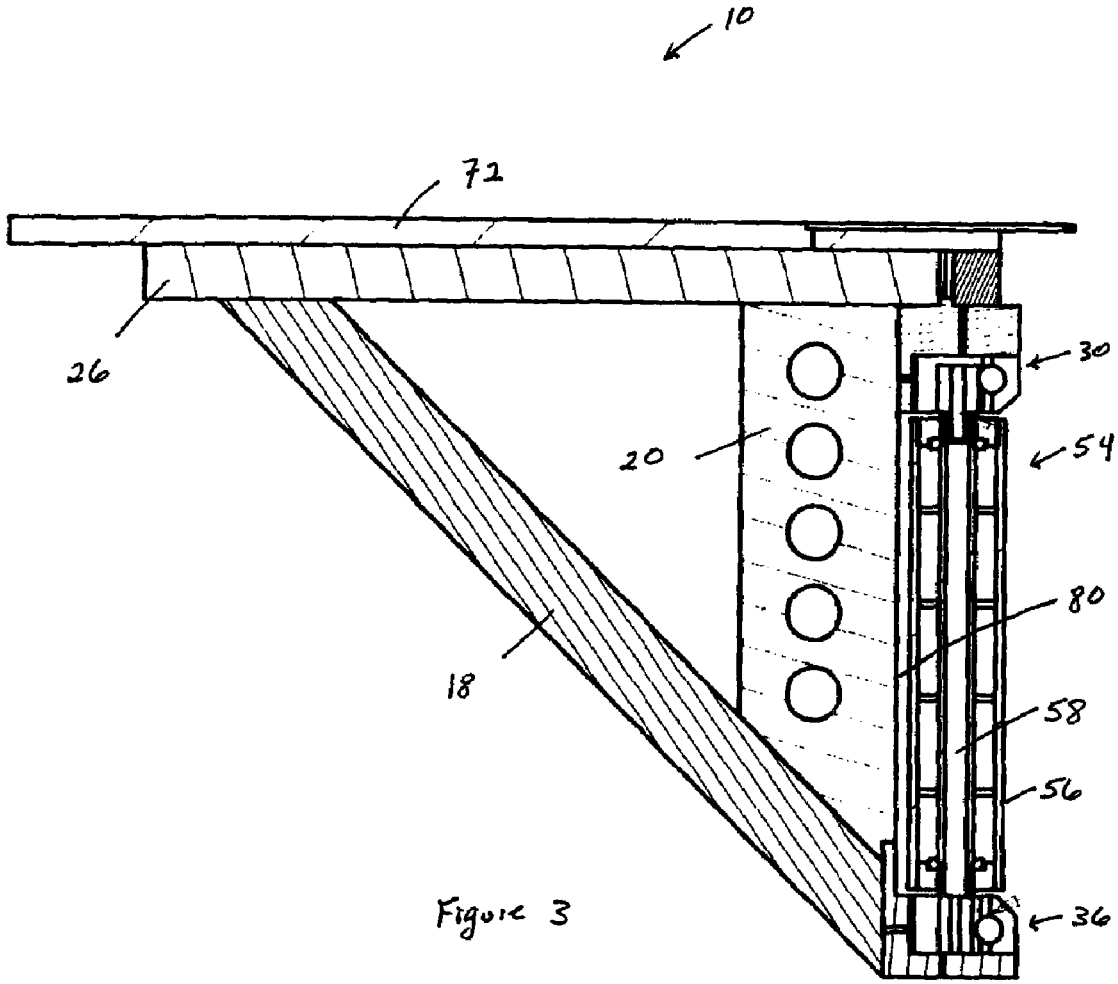
FIG. 3 is a schematic illustrating a longitudinal section of the engaging rod assembly depicted in FIG. 2.
Figure 4:
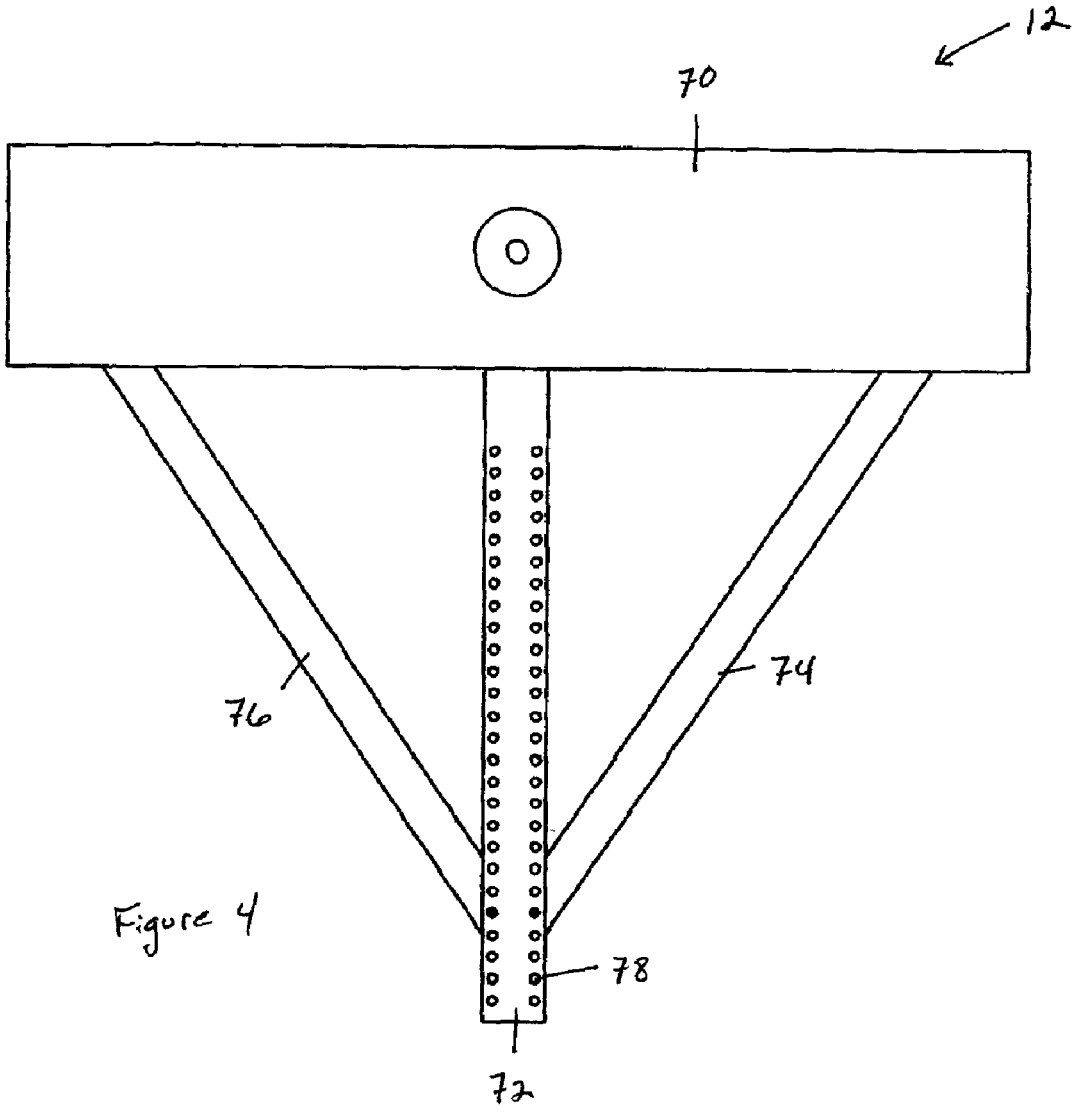
FIG. 4 is a schematic illustrating an exemplary support member.

The express docking system is designed to engage a boating vessel upon mooring of the boating vessel to a dock. As used herein and throughout, "boating vessel" refers to a wide variety of types and sizes of boats, including without limitation, for example, a catamaran, a mono-hull, a ferry, a cargo ship, and the like, wherein a catamaran is particularly well suited to the present invention.

The express docking system comprises an engaging rod assembly, a mooring assembly, and a signal indicator assembly. The engaging rod assembly is disposed on the boating vessel, and, depending on the type and size of the boating vessel, preferably on an underside, front, back, or side of the boating vessel. The mooring assembly and the signal indicator assembly are preferably installed on a dock, wherein a floating dock is a particularly preferred type of dock. For purposes of this invention, a floating dock is a dock supported by bars on which the dock can move up and down with the rise and fall of the water level, as such a floating dock is conventionally known in the art.

In general terms, the mooring assembly engages with the engaging rod assembly to both secure and detach the boating vessel to and from the dock. The signal indicator assembly interacts with the mooring assembly to signal when the boating vessel has been securely docked thereby ensuring the safe loading or unloading of passengers and/or cargo onto or from the boating vessel. Additionally, the signal indicator indicates when the boating vessel is not properly secured to the dock, thereby indicating that passengers and/or cargo should not enter or exit the boating vessel.

The various assemblies forming the express docking system, and their cross-interaction with each other, will now be explained in detail with reference to the figures. However, the figures are only illustrative, and are not to be construed as limiting as they incorporate obvious modifications and derivations to what is disclosed herein.

A. ASSEMBLIES

1. Engaging Rod Assembly.

Although the engaging rod assembly will have differently configured and types of attachments depending on the type and size of a particular boating vessel, an exemplary engaging rod assembly is depicted in FIGS. 1-4. Referring to FIGS. 1-4, engaging rod assembly 10 comprises a support member 12 and a rod subassembly 14. Rod subassembly 14 comprises a main frame 11 and an engaging rod 54. Main frame 11 comprises a T-frame 16 supported by an angled frame member 18 and a vertical frame member 20, wherein vertical frame member 20 is joined to angled frame member 18 at an acute angle. Vertical frame member 20 comprises a plurality of apertures 22 to reduce the weight of rod subassembly 14. Each of bars 24 and 26, which form T-frame 16, comprises a plurality of holes 28. Attached to bar 26 and vertical frame member 20 is an upper receiver 30 and attached to angled frame member 18 and vertical frame member 20 is a lower receiver 32. Each of upper and lower receivers 30 and 32 comprises a respective channel 34 and 36 respectively bordered by a side wall 38 and 40 and a side wall 42 and 44. Each of side walls 38, 40, 42, and 44 comprises a respective pin hole 46, 48, 50 and 52, wherein pin holes 46 and 48 are aligned with each other and pin holes 50 and 52 are aligned with each other.

As previously stated, rod subassembly 14 further comprises engaging rod 54. Engaging rod 54 comprises a cylindrical body 56 having an interior cavity 58. Extending from the terminal ends of engaging rod 54 are an upper extension 60 and a lower extension 62 respectively. Attached to upper extension 60 and to upper receiver 30 is a tether 64, wherein, when not largely exposed, tether 64 is preferably largely contained within upper extension 60.

Engaging rod 54 fits onto main frame 11 by fitting upper extension 60 within channel 34 of upper receiver 30 and by fitting lower extension 62 within channel 36 of lower receiver 32. A break away pin 66 fits through pin holes 46 and 48 and a break away pin 68 fits through pin holes 50 and 52 to secure engaging rod 54 to main frame 11. A space 80 is created between cylindrical body 56 and vertical frame member 20.

Support member 12 comprises a mount 70, a central fin 72 attached perpendicularly to mount 70, a proximal fin 74 attached to mount 70 and to central fin 72 at an acute angle, and a distal fin 76 attached to mount 70 and to central fin 72 at an acute angle. Central fin 72 comprises a plurality of holes 78. Furthermore, an underside of mount 70 comprises a plurality of holes (not shown). Plurality of holes 78 and plurality of holes located on mount 70 are arranged to facilitate location of the engaging rod with mooring assembly 100, wherein plurality of holes 28 located on T-frame 16 are designed to be aligned with plurality of holes 78 and the plurality of holes on mount 70 such that screws, nails, bolts, or other fastening means may be used to secure support member 12 to rod subassembly 14.

It is further noted that support member 12 may be permanently or non-permanently attached to a boating vessel. In an exemplary embodiment, support member 12 is welded to an underside of the boating vessel, although placement will ultimately depend on the type and size of the boating vessel. Such permanent attachment is particularly preferred as welding causes the least amount of modification to the boating vessel. Additionally, although rod subassembly 14 is shown as being removably attached to support member 12, i.e., fastening means, such as screws, can secure the two members together, it is contemplated that support member 12 can be permanently attached to rod subassembly 14; alternatively, support member 12 may be eliminated, and rod subassembly 14 may be directly attached to the boating vessel.

Although the materials forming support member 12 and main frame 11 may vary provided that the material is durable and corrosion-resistant, in an exemplary embodiment, the material comprises aluminum. Additionally, in an exemplary embodiment, engaging rod 54 comprises stainless steel-type 316SS, 17-4PH Cond. 1075 and/or other corrosion-resistant metal(s).

Other than for engaging with mooring assembly 100, engaging rod 54 is also designed to safely release the boating vessel from jaws subassembly 102 of mooring assembly 100 in the event that dangerously high forces, i.e., forces that might impair the functionality of the express docking system, are exerted on engaging rod assembly 10 and on the boating vessel. Accordingly, engaging rod 54 is designed to withstand adequate mooring forces while releasing the boating vessel in the event of excessive forces. Therefore, objects of engaging rod 54 include: (1) ensuring that engaging rod 54 does not release when the boating vessel is moored and the forces are acceptable; and (2) disengaging the boating vessel when exposed to extreme forces to prevent any damage to the boating vessel or to the engaging rod assembly.

It is noted that engaging rod assembly 10 is particularly well adapted for disposal on the underside of a catamaran style of boating vessel. However, it is contemplated herein that the engaging rod assembly may be adaptable to various styles and types of boating vessels, wherein the element that is most necessary to the purpose of this invention, i.e., to securing a boating vessel to a mooring assembly, is accomplished by rod subassembly 14.

2. Mooring Assembly.

Figure 5:
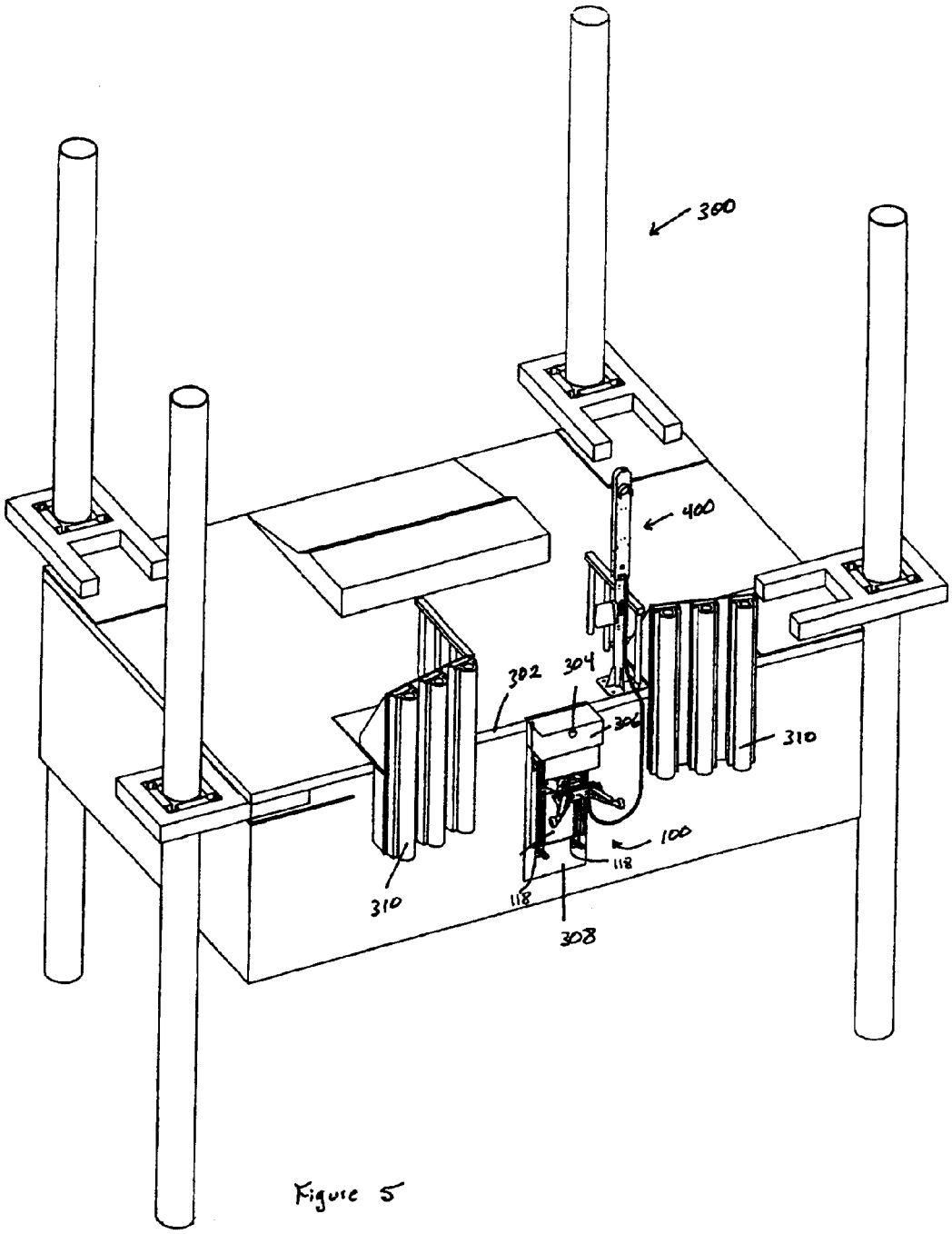
FIG. 5 is a schematic illustrating an exemplary mooring assembly and an exemplary release level assembly disposed on an exemplary floating dock.

An exemplary mooring assembly is discussed with reference to FIGS. 5-18 and 30-33. Referring to FIG. 5, in an exemplary embodiment, a mooring assembly 100 is installed in the center of a floating dock's 300 front panel 302, allowing for the advancement of the boating vessel straight in towards dock 300.

Figure 6:
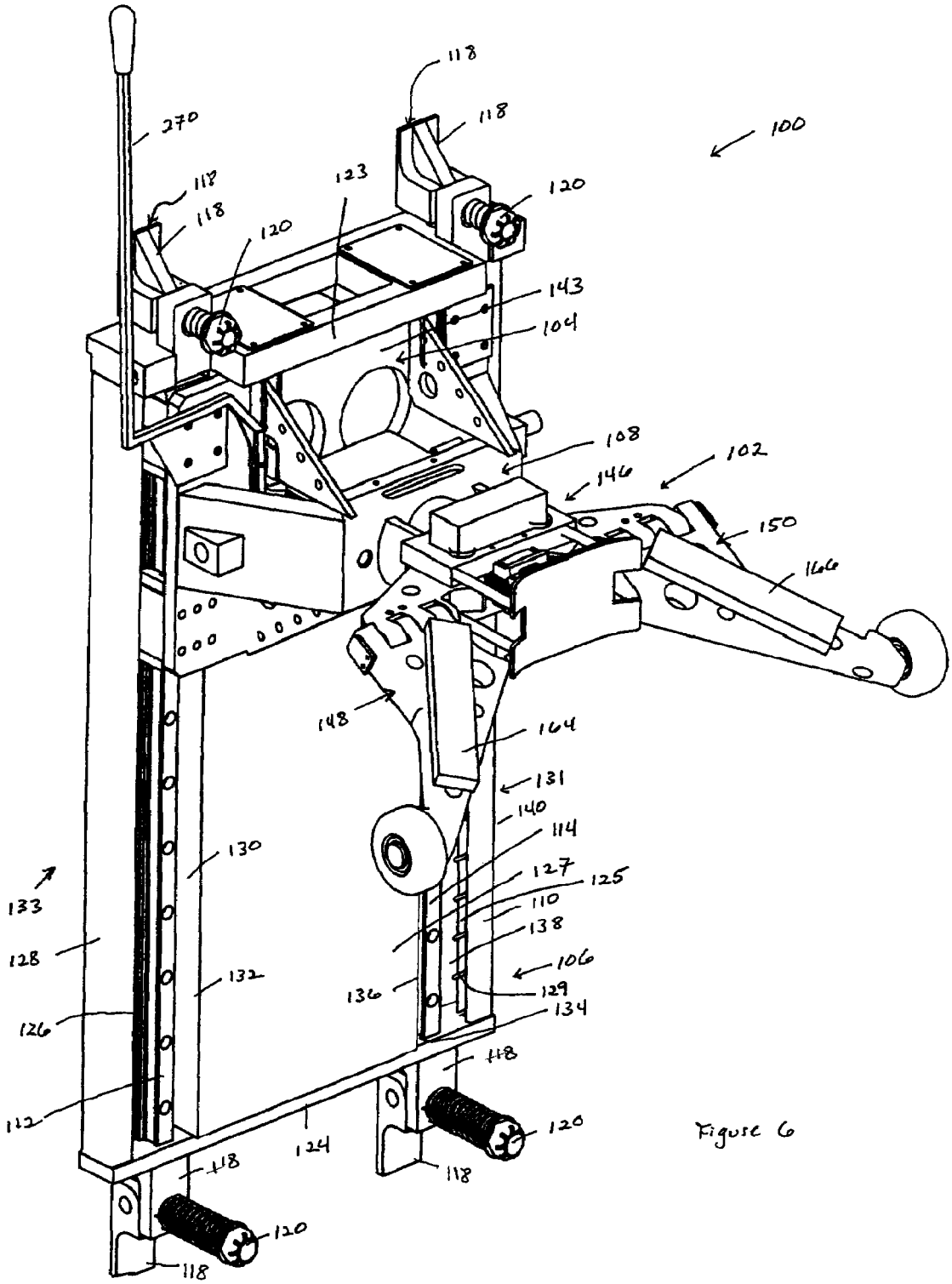
FIG. 6 is a schematic illustrating an elevational side view of an exemplary mooring assembly.

Referring to FIG. 6, mooring assembly 100 comprises a jaw subassembly 102, a carriage subassembly 104, a mounting subassembly 106, and an actuating subassembly 108. Optionally, referring to FIGS. 31-33, mooring assembly 100 may further comprise a torsion subassembly 101. Although the functions of each of the subassemblies will become apparent as the subassemblies are more particularly described below, in general jaw subassembly 102 engages and disengages with rod subassembly 14 thereby securing and releasing the boating vessel to and from floating dock 300. Mounting subassembly 106 secures mooring assembly 100 to floating dock 300, and, through its interaction with carriage subassembly 104 allows for the movement of mooring assembly 100 in relation to the surrounding water. Additionally, carriage subassembly 104 connects jaw subassembly 102 and actuating subassembly 108 to mounting subassembly 106. Actuating subassembly 108 assists in the disengagement of rod subassembly 14 from jaw subassembly 102, and also assists in signaling when the boating vessel is properly contained by jaw subassembly 102 or disengaged from jaw subassembly 102. Optional torsion subassembly 101 assists in angling certain components of jaw subassembly 102 to reduce the likelihood of harm or damage to the boating vessel.

Although the various parts forming mooring assembly 100 may comprise a wide variety of materials capable of withstanding an aqueous, saline environment, one or more of the following materials is particularly preferred: stainless steel-type 316SS, 17-4PH Cond. 1075, and other corrosion resistant steels. Each of the subassemblies of mooring assembly 100 shall now be described in turn.

a. Mounting Subassembly.

Referring to FIG. 5, mounting subassembly 106 is mounted onto floating dock 300 such that tabs 118 of mounting subassembly 106 are preferably welded, or otherwise securely attached, onto a side frame 308 or other supporting structure located on floating dock 300.

Figure 7:
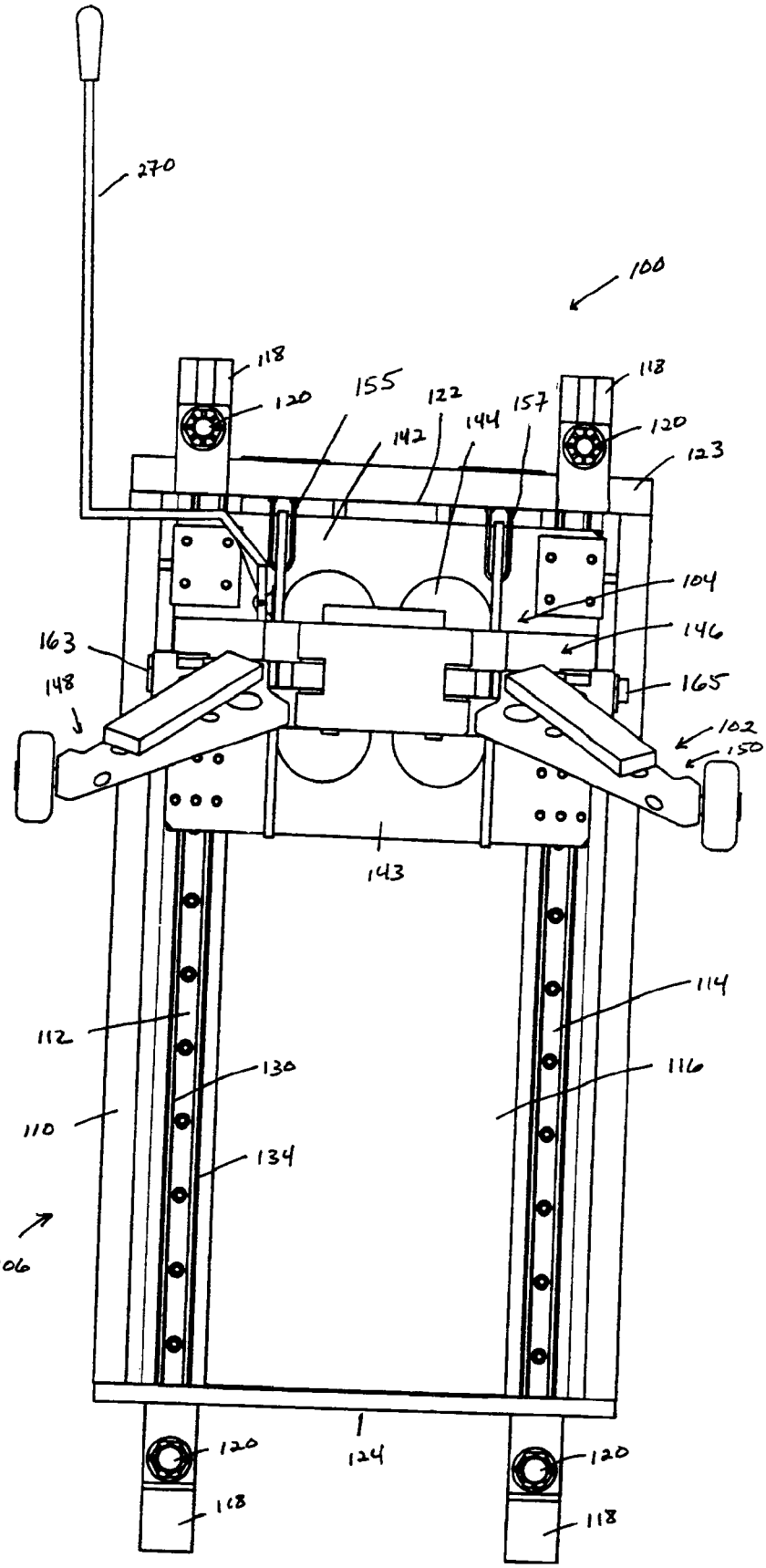
FIG. 7 is a schematic illustrating a front view of the mooring assembly depicted in FIG. 6.

Referring to FIGS. 6 and 7, mounting subassembly 106 further comprises rails 112 and 114 which extend vertically along a top surface 116 of base 110. Mounting subassembly 106 further comprises a channel 126 bordered by an outer side edge 128 and rail 112, a channel 130 bordered by an inner side edge 132 and rail 112, a channel 134 bordered by an inner side edge 136 and rail 114, and a channel 138 bordered by an outer side edge 138 and rail 114.

Figure 10:
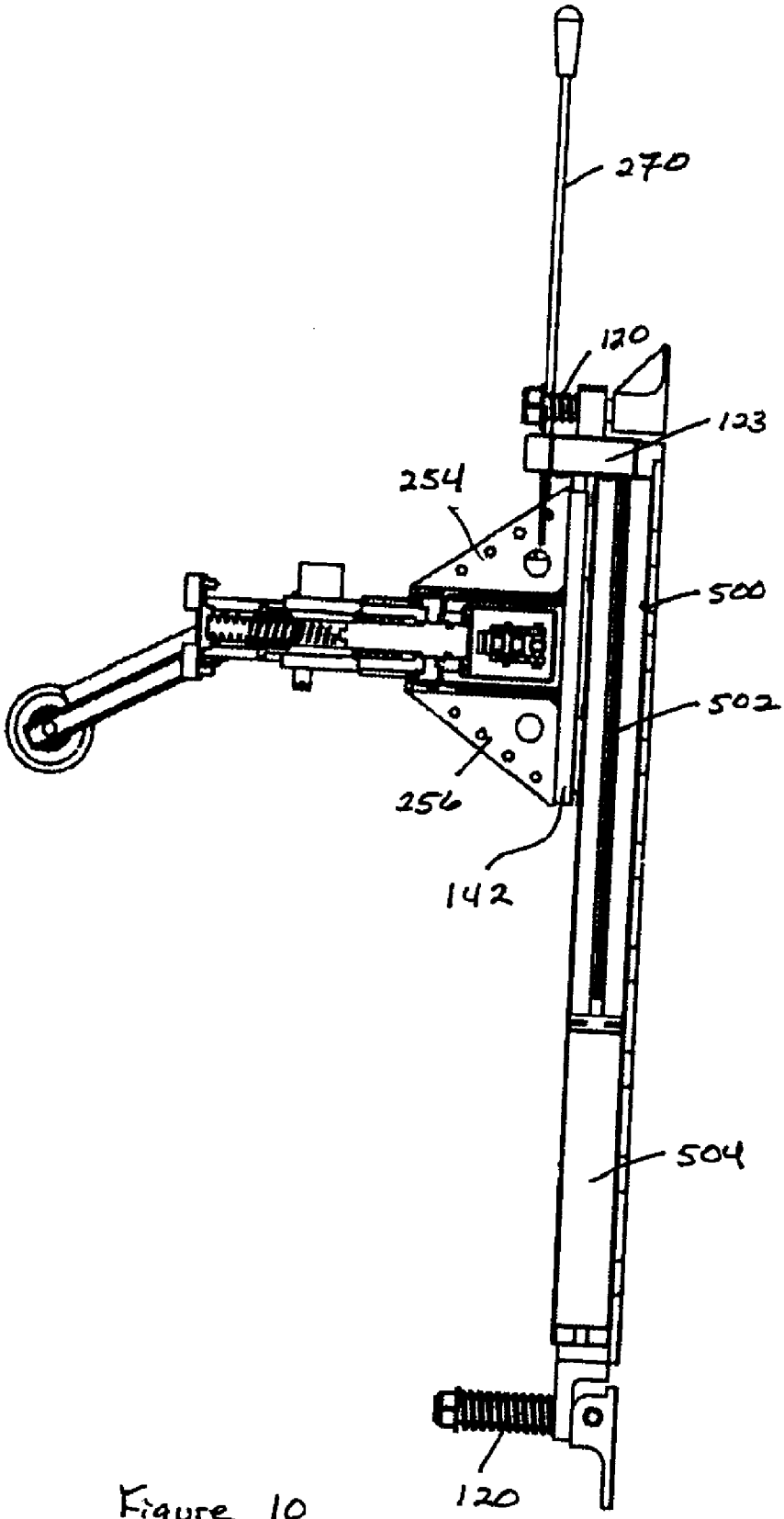
FIG. 10 is a schematic illustrating a profile view of an exemplary mooring assembly.

Referring to FIGS. 6, 7, and 10, mounting subassembly 106 further comprises a stop bar 123 located on a top side 122 of base 110. As understood more clearly later on herein, stop bar 123 provides an upper limit to a pulley unit 500 thereby securing carriage subassembly 104 to mounting subassembly 106.

Referring to FIG. 6, mounting subassembly 106 further comprises a vertical rod 125 located on a proximal side 131 of mounting subassembly 106 and a vertical rod (not shown) located on a distal side 133 of mounting subassembly 106. Each of the vertical rods extends from a bottom side 124 of mounting subassembly 106 towards top side 122. Additionally, each of the vertical rods comprises a spring 129 coiled around the length of the respective vertical rod. As will be understood more fully below, the vertical rods and springs 129, in combination with locating tabs 145 located on carriage subassembly 104 (see FIG. 14), assist in holding carriage subassembly 104 at a zero position when the boating vessel is disengaged from mooring assembly 100. This is useful in that it brings carriage subassembly 104, and hence, jaw subassembly 102, into proper alignment for the mooring of subsequent boating vessels.

Referring to FIGS. 6, 7, and 10, extending from a face 127 of mounting subassembly 106 are a plurality of tabs 118 each comprising throughholes for the insertion of a plurality of springs 120. Springs 120 assist in absorbing the force of the impact of the boating vessel and the water. Springs 120 further assist in lifting the boating vessel against the floating dock, thereby protecting the boating vessel and the floating dock.

Figure 23:
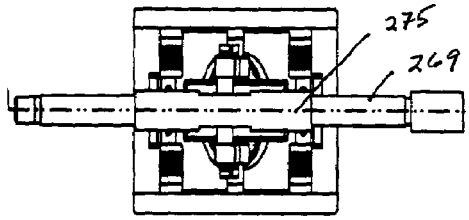
Figure 24:
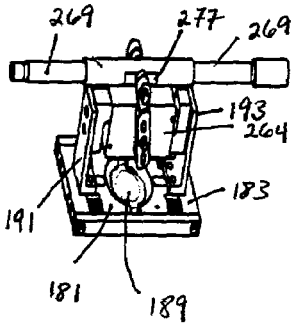
Figure 25:
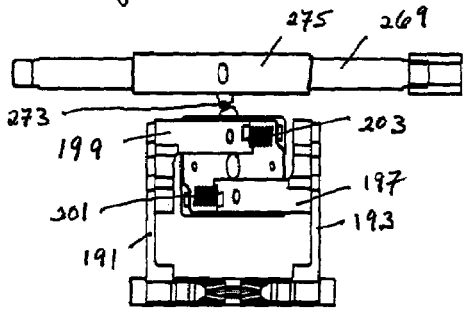
Figure 26:
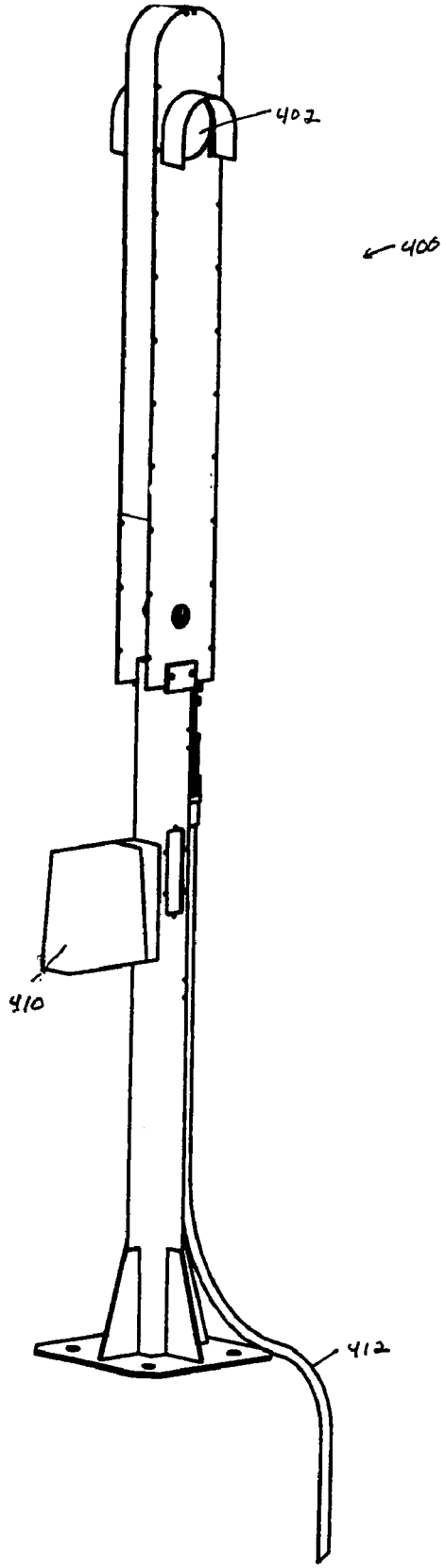
FIG. 26 is a schematic illustrating an exemplary signaling assembly.
Figure 27:
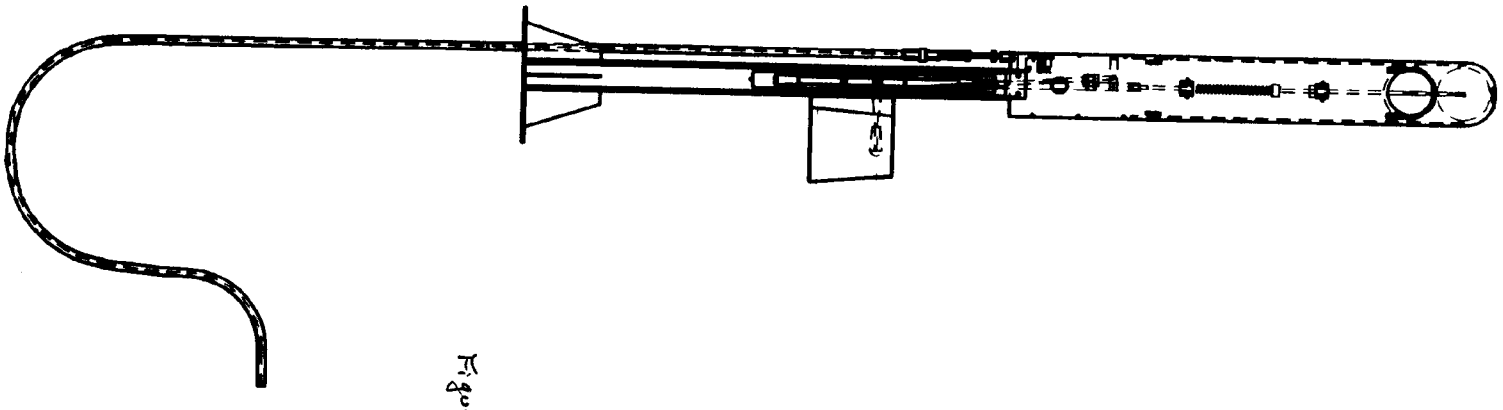
FIG. 27 is a schematic illustrating an interior front view of the signaling assembly depicted in FIG. 26.
Figure 28:
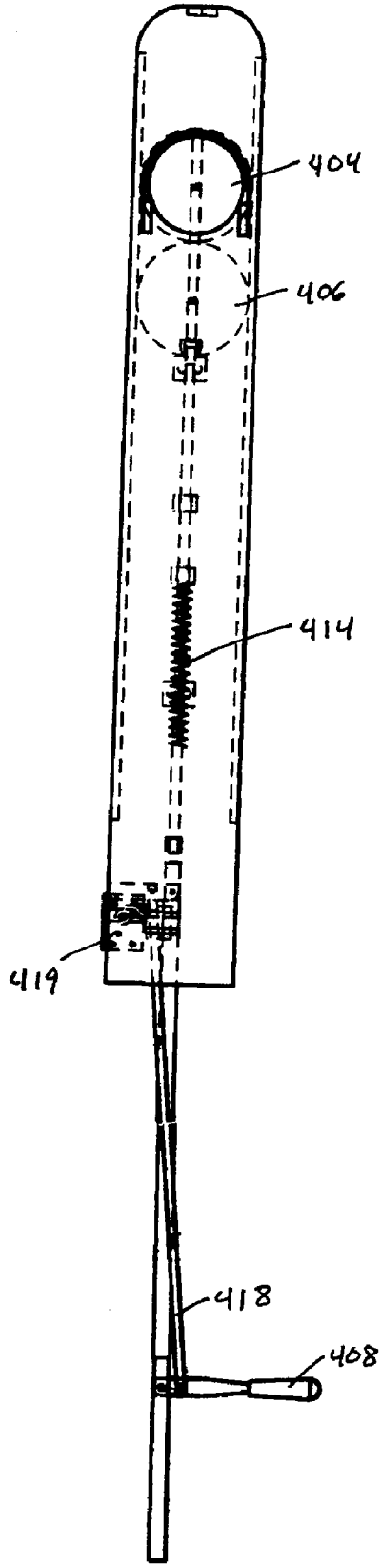
FIG. 28 is a schematic illustrating an interior front view of an upper portion of signaling assembly depicted in FIGS. 26 and 27.
Figure 19:
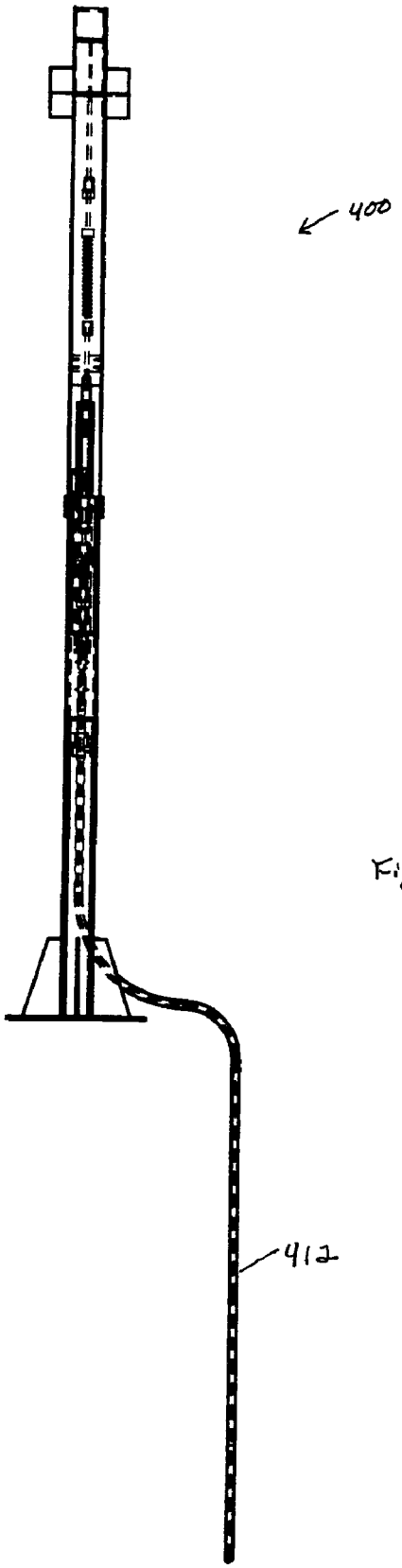
Figure 30:
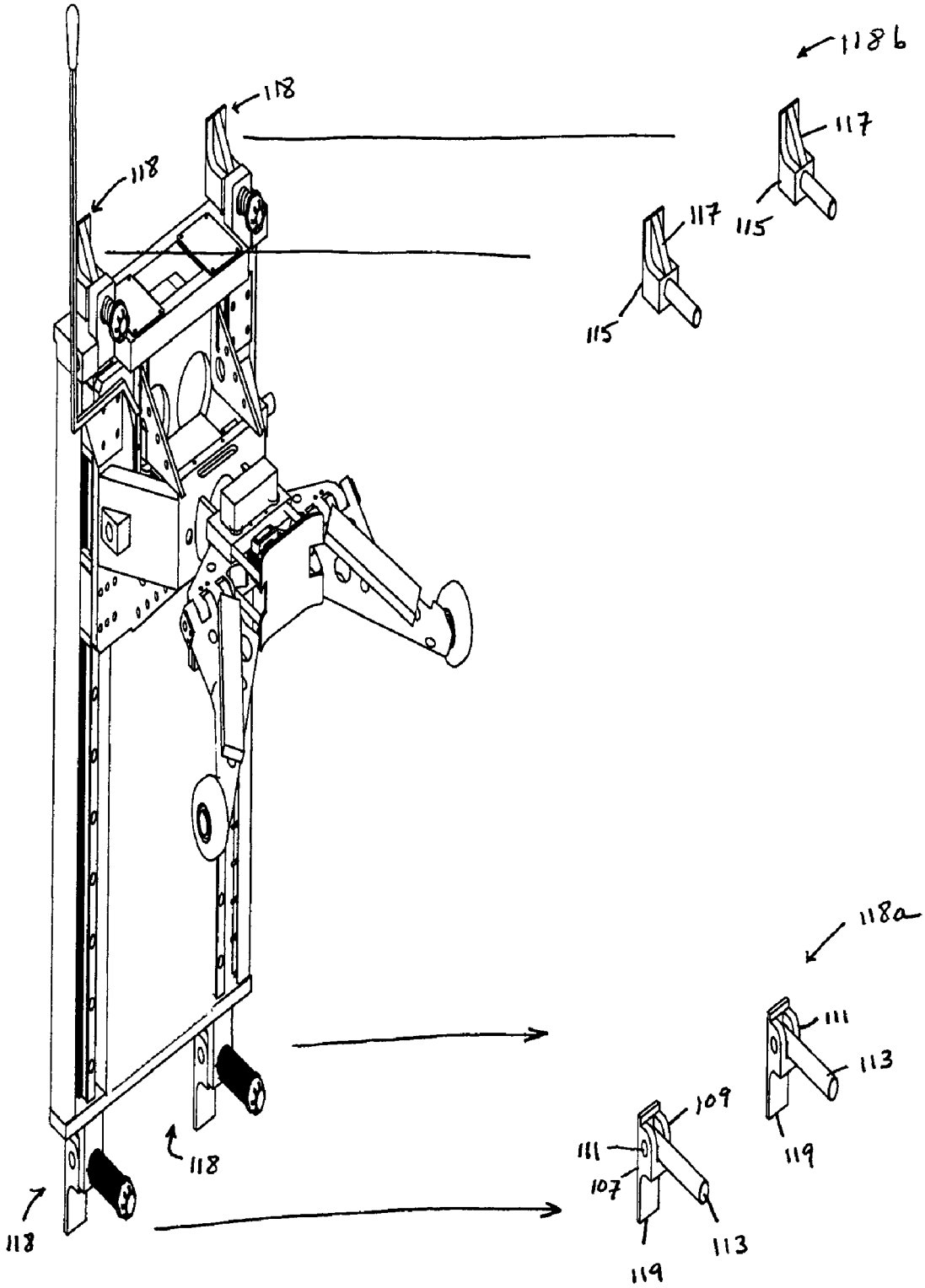
FIG. 30 is a schematic illustrating exemplary tabs from an exemplary mounting subassembly.

Plurality of tabs 118 serve to mount mounting subassembly 106 onto floating dock 300. Additionally, plurality of tabs 118 assist in providing movement between mounting subassembly 106 and carriage subassembly 104. For example, referring to FIG. 23, lower tabs 118*a* comprise a mounting element 119, which is preferably welded to the dock. Additionally, tabs 118 comprise protruding side walls 107 and 109 each of which comprises an aperture 111. A rod 113 is disposed between protruding side walls 107 and 109 and is secured to tab 118 via a fastening element, such as a pin or a screw, for example, positioned through apertures 111. Rod 113 is above to move in a hinged fashion through the space created between protruding side walls 107 and 109. Accordingly, rod 113 can move mounting assembly 106 in an upward and downward direction.

Upper tabs 118*b* each comprises a mounting element 115, which may be welded to the dock. Additionally, each of upper tabs 118*b* comprises a flexible band 117. In the event that rods 113 from lower tabs 118*a* move upwards, thereby moving base 110 upwards, flexible bands 117 allow for such upward movement, and also provide the spring mechanism whereby base 110 is again moved downwards.

As such, plurality of tabs 118 provide flexibility of movement to mounting subassembly 106, thereby enhancing the durability of mounting subassembly as such movement safeguards mounting subassembly 106 from harm in the event that it is exposed to harsh environmental conditions.

b. Carriage Subassembly.

Referring to FIGS. 6 and 7, carriage subassembly 104 comprises a plate 142 having a front side 143 opposite to a back side (not shown). Plate 142 further comprises a plurality of throughholes 144 bored from front side 143 to the back side. Throughholes 144 serve to reduce the weight of carriage subassembly 104.

Carriage subassembly 104 is slidably engaged with mounting subassembly 106 via a plurality of U-shaped sliders 146, wherein a leg of one of the U-shaped sliders fits within channel 126 and another leg of the same U-shaped slider fits within channel 130, and wherein a leg of another U-shaped slider fits within channel 134 and another leg of the same U-shaped slider fits within channel 138.

It is important that carriage subassembly 104 be movably fixed onto mounting subassembly 106, i.e., that carriage subassembly 104 be able to move vertically along carriage subassembly 104, such that carriage subassembly 104, jaw subassembly 102, actuating subassembly 108, and optional torsion subassembly 101, can move in a vertical motion along with the boating vessel, wherein such movement of the boating vessel is caused either by waves and/or by the loading and unloading of passengers and/or cargo, as such flexibility in motion enhances the durability of mooring assembly 100. Accordingly, via sliders 146, carriage subassembly 104, jaw subassembly 102, actuating subassembly 108, and optional torsion subassembly 101 can move in relation to the motion of the surrounding water, thereby providing flexibility to mooring assembly 100.

However, to ensure that carriage subassembly 104 can move upwards once it has been moved downwards, mooring assembly 100 further comprises a pulley unit 500. Referring to FIG. 10, pulley unit 500 comprises a pulley wheel (not shown), which is obscured by stop 123 of mounting subassembly 106, a counterweight 504, and a chord 502. Chord 502, is looped over the pulley wheel and is attached to plate 142 of carriage subassembly 104 at one end and to counterweight 504 at an opposite end. Counterweight 504 assists in moving carriage subassembly 104 upwards after it has been pulled downwards by the motion of the surrounding water.

Figure 14:
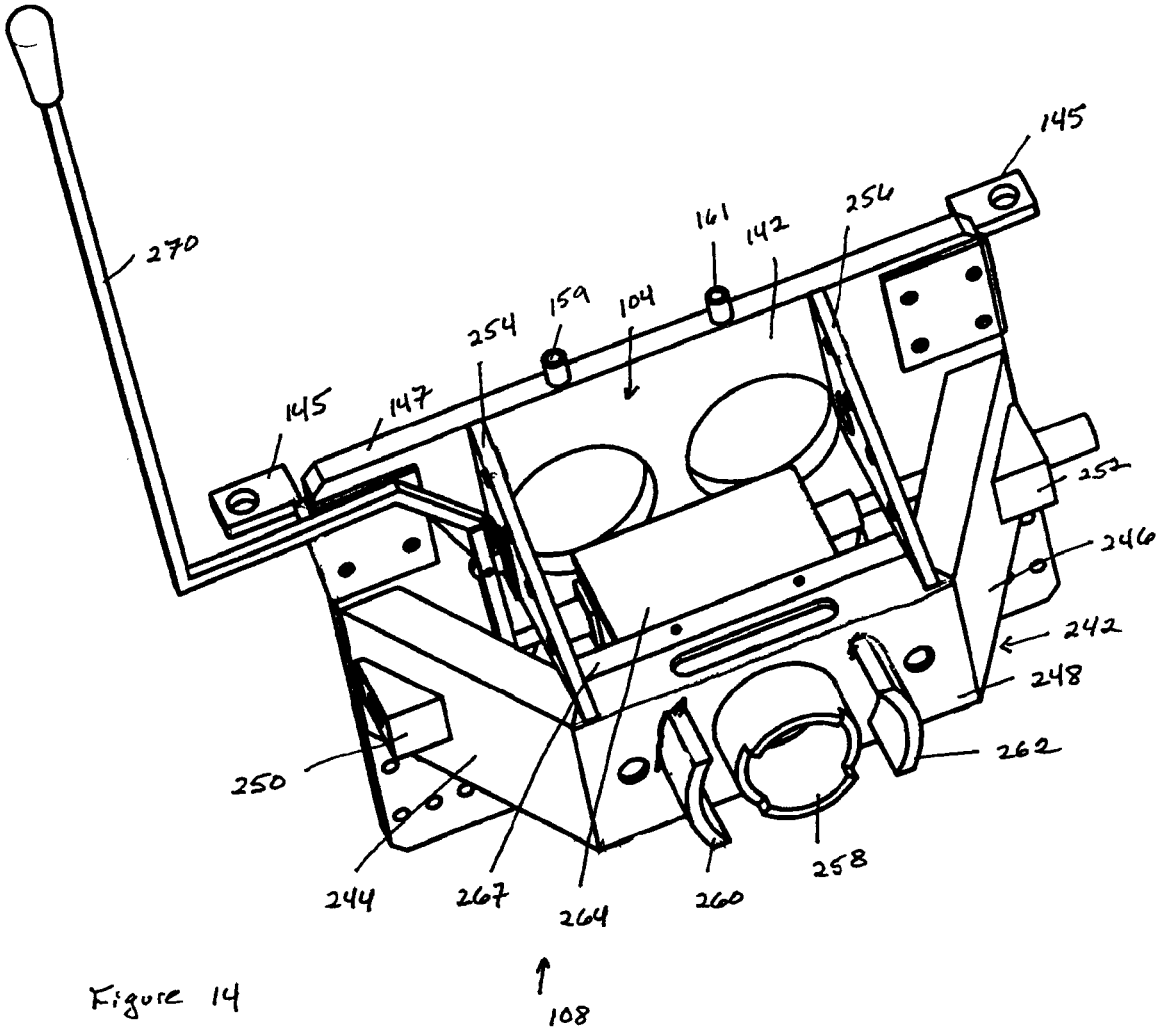
FIG. 14 is a schematic illustrating an exemplary actuating subassembly mounted to an exemplary carriage subassembly in an exemplary fashion.

As referenced above in the discussion of mounting subassembly 106, to further control the vertical movement of carriage subassembly 104 along the length of mounting subassembly 106, carriage subassembly 104 further comprises locating tabs 145 located at opposite sides of its top side 147 (see FIG. 14). Each of locating tabs 145 is respectively connected to springs 129, which are coiled around the vertical rods of mounting subassembly 106. As discussed above, the combination of the vertical spring rods and the locating tabs assists in moving carriage subassembly 104 to zero position such that carriage subassembly 104, and, hence, jaw subassembly 102, will be at the same position each time a boating vessel is ready to dock utilizing mooring assembly 100.

Additionally, referring to FIG. 7, carriage subassembly 104 comprises bumpers 155 and 157, and, referring to FIG. 14, further comprises bumpers 159 and 161. Bumpers 155, 157, 159, and 161 serve to reduce noise and to reduce the likelihood of damage to mooring assembly 100 when carriage subassembly 104 contacts stop 123 of mounting subassembly 106.

c. Jaw Subassembly.

Referring to FIGS. 6-13, jaw subassembly 102 is mounted onto plate 142 of carriage subassembly 104. Jaw subassembly 102 is perhaps the most visible part of the express docking system. The primary purpose of jaw subassembly 102 is to clamp around engaging rod 54, thus securely mooring the boating vessel during the loading and unloading of passengers and/or cargo.

Figure 8:
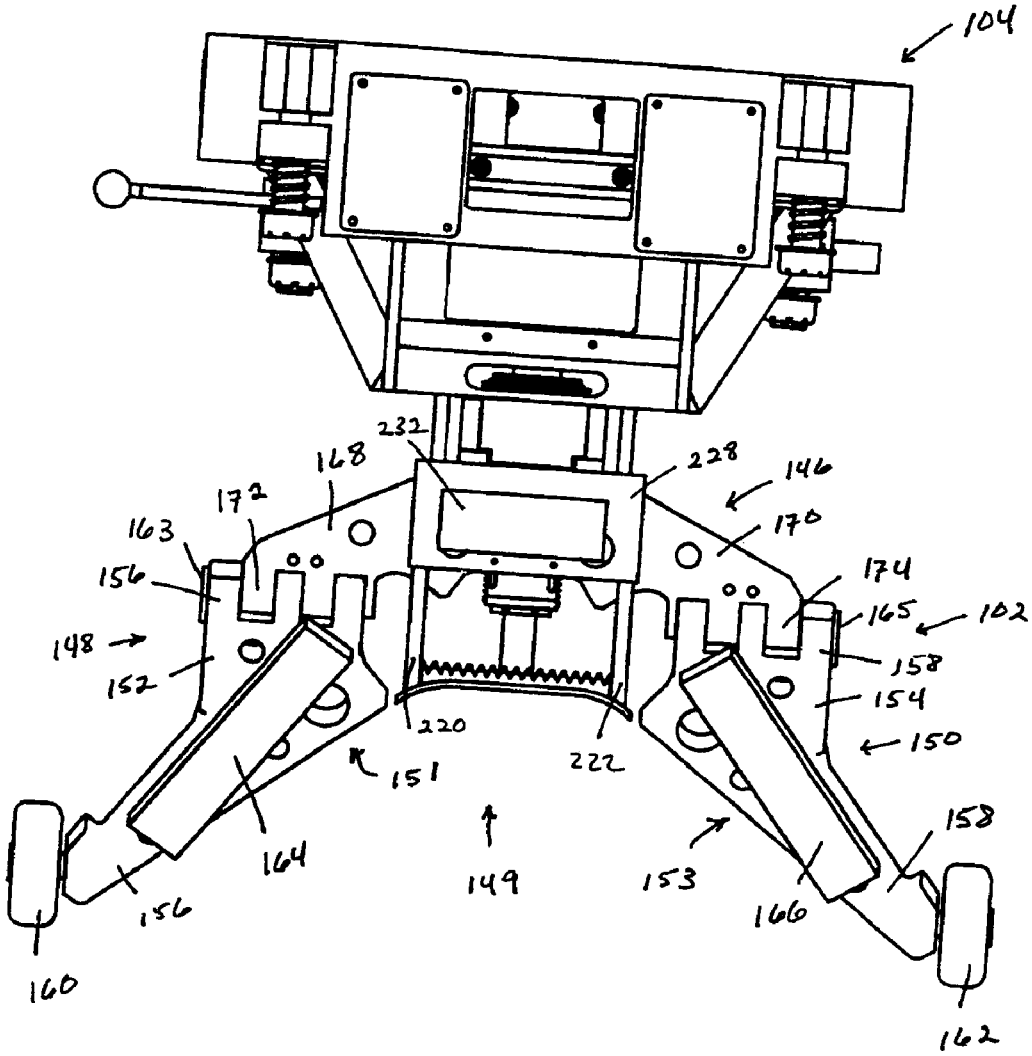
FIG. 8 is a schematic illustrating a side view of the mooring assembly depicted in FIGS. 6 and 7.
Figure 9:
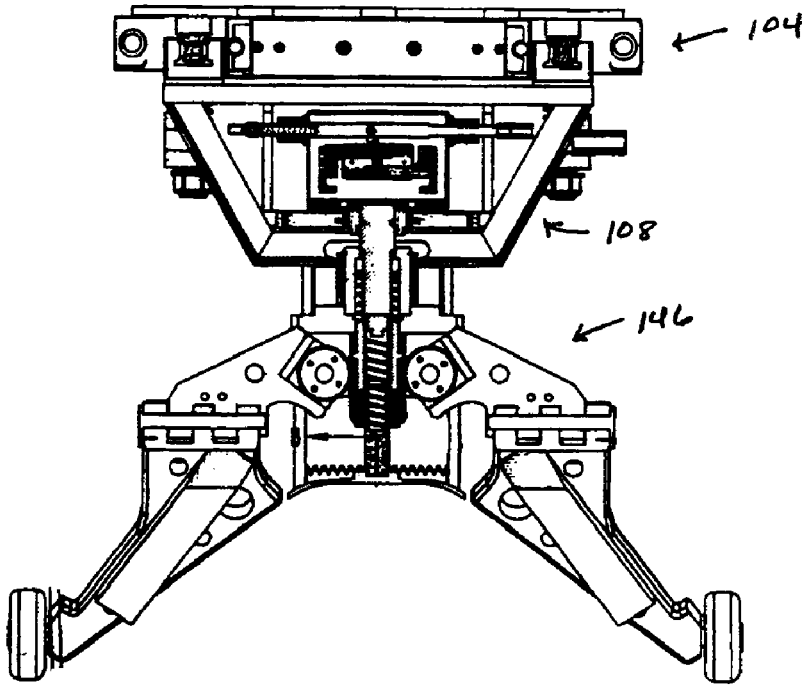
FIG. 9 is a schematic illustrating a cross-section of the mooring assembly depicted in FIG. 8.

Referring to FIGS. 6-8, jaw subassembly 102 comprises an engaging member 146 and jaw members 148 and 150. Referring to FIG. 8, jaw members 148 and 150 are attached to engaging member 146 such that a space 149 is formed between jaw members 148 and 150. Each of jaw members 148 and 150 respectively comprises a jaw 151 and a jaw 153. Each of jaws 151 and 153 respectively comprises a forearm 152 and 154, wherein each of forearms 152 and 154 has a plurality of fingerlike projections 156 and 158. Forearms 152 and 154 are respectively attached to or formed from upper arms 156 and 158 at an acute angle. Each of forearms 152 and 154 is preferably tapered to assist in leading the boating vessel towards engaging member 146.

Additionally, each of jaw members 148 and 150 comprises respective rollers 160 and 162 at terminal ends of upper arms 156 and 158. Rollers 160 and 162 facilitate the rolling of the boating vessel through space 149 and inward towards engaging member 146. Each of jaw members 148 and 150 further respectively comprises a buffer element 164 and 166 respectively disposed on top surfaces of jaws 151 and 153, wherein buffer elements 164 and 166 protect jaws 151 and 153 from the boating vessel.

Referring to FIGS. 8-12, engaging member 146 comprises flanges 168 and 170. Each of flanges 168 and 170 respectively comprises fingerlike extensions 172 and 174, which respectively interlock with fingerlike projections 156 and 158 of jaw members 148 and 150 in a hinged fashion, such as by way of hinge pins 163 and 165 which are inserted through fingerlike extensions and projections. The respective interconnectivity of flanges 168 and 170 with jaws 151 and 153 is such that jaws 151 and 153 are collapsible in a downward position, i.e., towards the body of water, when an excess amount of weight is applied to jaws 151 and 153. This mechanism, then, preserves the safety of the mooring assembly.

Additionally, each of flanges 168 and 170 further comprises respectively an upper lip 176 and 178 and a lower lip 180 and 182, wherein upper lips 176 and 178 are respectively attached to lower lips 180 and 182 at 90 degree angles. Each of upper lips 176 and 178 and lower lips 180 and 182 comprises grooves/ridges that correspond to grooves/ridges located on a respective gear 184 and 186, wherein gears 184 and 186 are respectively received by each of the upper and lower lips 176, 178, 180, and 182. As will be explained below, the grooves/ridges on the upper and lower lips and on gears 184 and 186 assist in closing jaws 151 and 153 around engaging rod 54.

Figure 11:
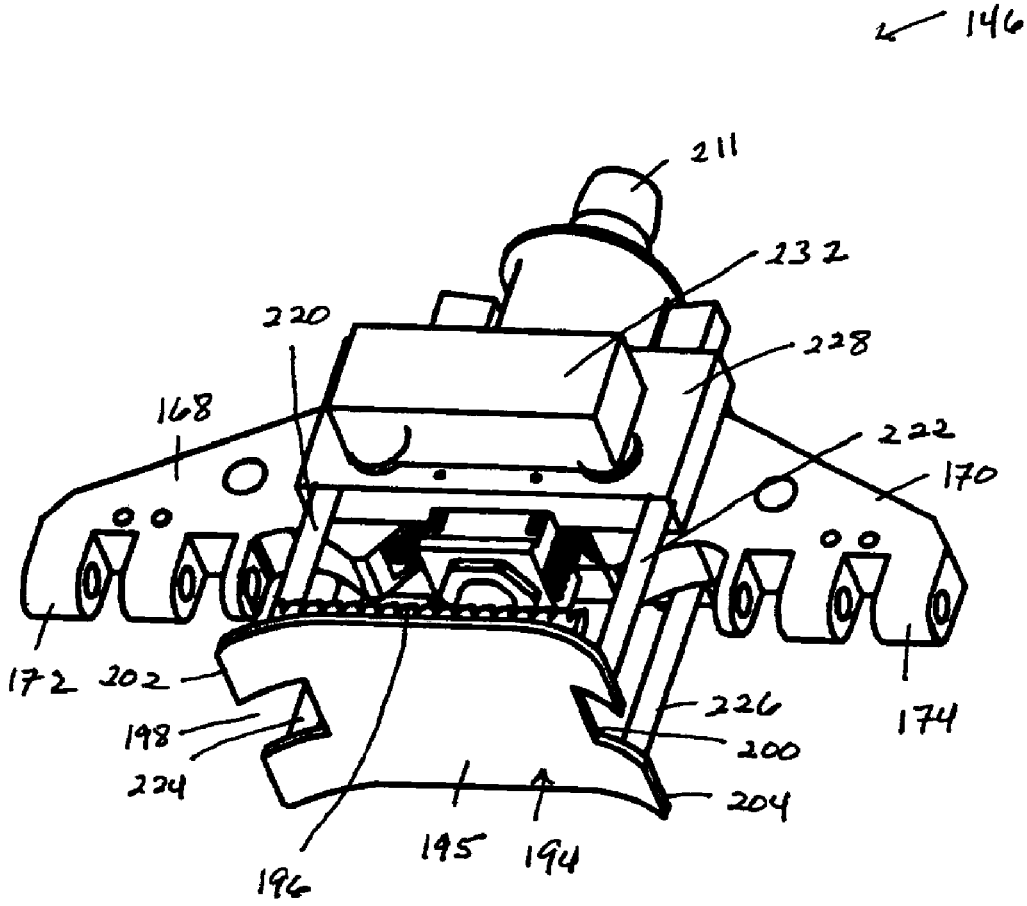
FIG. 11 is a schematic illustrating an exemplary engaging member of an exemplary jaw subassembly.
Figure 12:
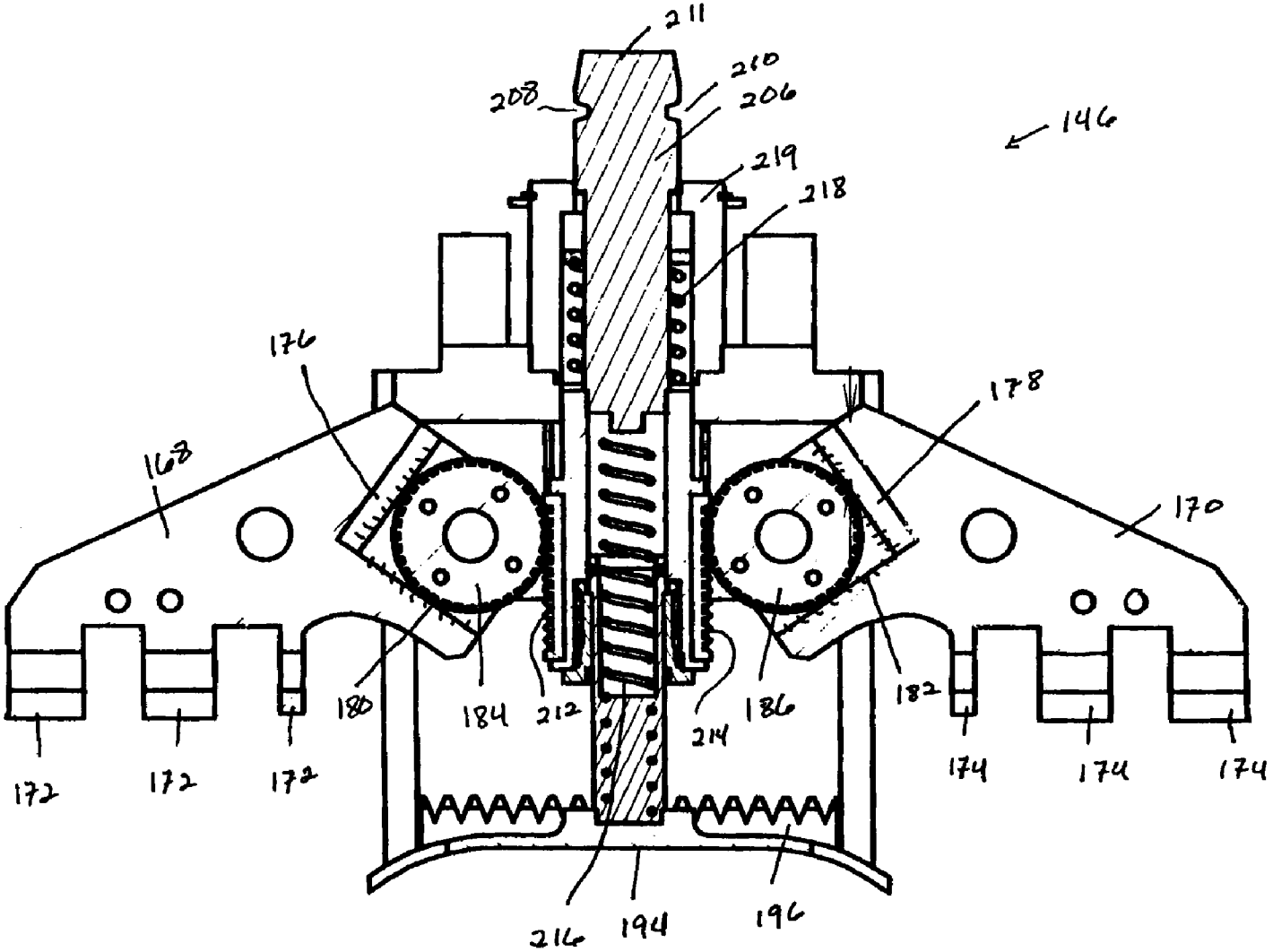
FIG. 12 is a schematic illustrating a cross-sectional view of the engaging member depicted in FIG. 11.
Figure 13:
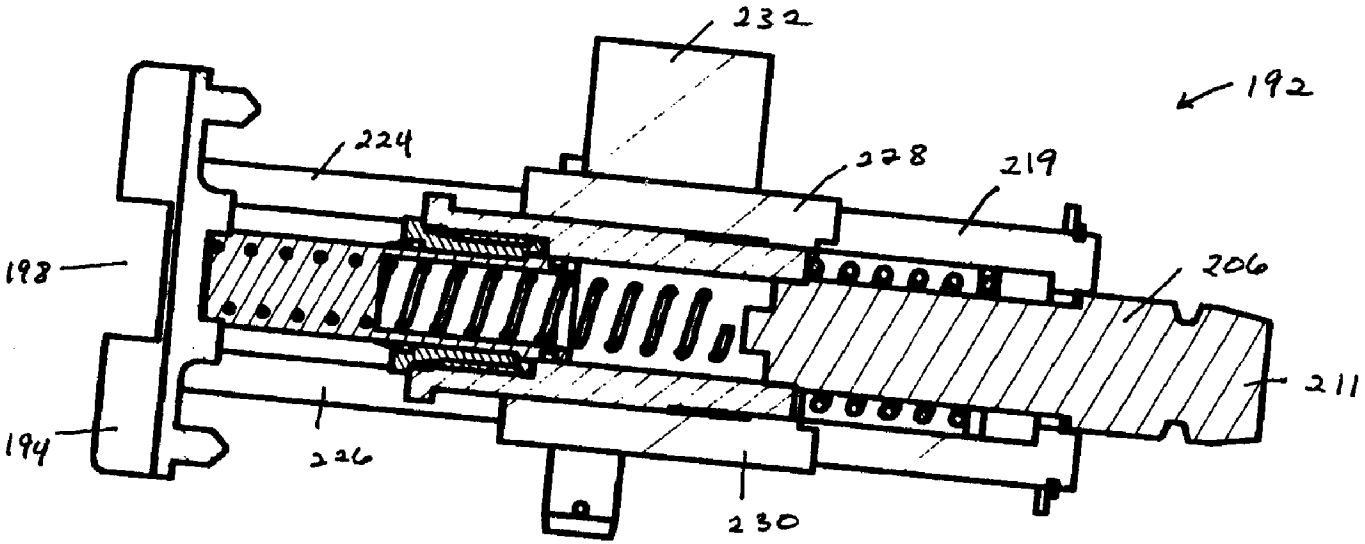
FIG. 13 is a schematic illustrating an exemplary plunger component of the engaging member depicted in FIGS. 11 and 12.

Referring to FIGS. 11-13, engaging member 146 further comprises a plunger component 192. Plunger component 192 comprises a platform 194. Platform 194 comprises a series of teeth 196 along a bottom surface of platform 194. Series of teeth 196 serves to remove any ice that may accumulate between plunger component 192 and the remainder of jaw subassembly 102 and/or carriage subassembly 104. Lateral terminal ends 202 and 204 of platform 194 slope outwardly away from a top side 195 thereby preventing engaging rod 54 from positioning itself behind platform 194. Additionally, along with series of teeth 196, the sloped lateral terminal ends 202 and 204 act as ice breakers. The ice breaker function is activated when the boating vessel begins to push against platform 194. Additionally, platform 194 comprises cutouts 198 and 200 respectively located on lateral terminal ends 202 and 204. Cutouts 198 and 200 are formed to prevent obstruction between platform 194 and fingerlike extensions 172 and 174 of flanges 168 and 170 when platform 194 is moved towards flanges 168 and 170.

Referring to FIGS. 12 and 13, plunger component 192 further comprises a shaft 206 which extends from a center of platform 194. Shaft 206 comprises indentations 208 and 210 and terminates in a cap 211. As will be explained in further detail below with reference to actuating subassembly 108, indentations 208 and 210 serve as the site at which plunger component 192 is releasably locked to actuating subassembly 108, thereby preventing plunger component 192 from moving backwards away from actuating subassembly 108.

On either side of shaft 206 and in communication therewith, are lateral extension elements 212 and 214. Each of lateral extension elements 212 and 214 are ribbed to form grooves/ridges which correspond to and are in physical contact with the respective grooves/ridges of gears 184 and 186. In combination with gears 184 and 186, extension elements 212 and 214 will assist in mechanically opening and shutting jaws 151 and 153 to secure engaging rod 54.

Plunger component 192 further comprises an outer spring 216 wrapped around shaft 206, and an inner spring 218 coiled within the interior of shaft 206. Plunger component 192 further comprises a block 219 which is engaged with shaft 206, and which contains spring 216. Block 219 moves with shaft 206 and assists in locking/releasing cap 211 from actuating subassembly 108. In an exemplary embodiment, the block is by ball points for easy and frictionless movements.

Referring to FIGS. 8, 11, and 13, bars 220 and 222, which extend from platform 194 to a box 228, and bars 224 and 226 which extend from platform 194 to a box 230, provide further connective support between plunger component 192 and the rest of engaging member 146. Additionally, bars 220, 222, 224, and 226 prevent the rotation of plunger component 192 and assist in the lateral motion of plunger component 192. Resting atop box 228 and 230 respectively is a cover 232. Cover 232 serves to prevent water and other elements from disrupting the movement of gears 184 and 186.

Through the operation of flanges 168 and 170, plunger component 192, grooved gears 184 and 186, grooved lateral extension elements 212 and 214, grooved upper lips 176 and 178, and grooved lower lips 180 and 182, jaws 151 and 153 may be opened and closed. That is, as plunger component 192 moves inward, i.e., towards actuating subassembly 108, and the grooves/ridges of lateral extension elements 212 and 214 move along the grooves/ridges of gears 184 and 186 causing gears 184 and 186 to rotate. As gears 184 and 186 rotate, the grooves/ridges of gears 184 and 186 move along grooves/ridges of upper lips 176 and 178 and lower lips 180 and 182 causing flanges 168 and 170 to move towards each other. As jaws 151 and 153 are respectively connected to flanges 168 and 170, such motion causes jaws 151 and 153 to move towards each other. Accordingly, as plunger component 192 is compressed, jaws 151 and 153 move towards each other. By reversing the rotation of gears 184 and 186, jaws 151 and 153 move away from each other. Such a reversal of rotation is caused by the decompression of plunger component 192 via outer spring 216 and inner spring 218 as explained below in further detail.

Accordingly, the primary purpose of plunger component 192 is to control the locking and release mechanism of jaw subassembly 102. As explained below, when engaging rod 54 pushes against platform 194 of plunger component 192, the inward horizontal motion of plunger component 192 causes jaws 151 and 153 to secure engaging rod 54 between jaws 151 and 153. In an exemplary embodiment, critical timing, defined as the time when the jaws begin to lock, occurs when the plunger reaches approximately 0.5 inch from the end of inward motion. The approximate 0.5 inch point marks the beginning of full closure and the actual locking of jaws 151 and 153. Critical timing was established at about 0.5 inch for the following reasons: (1) this distance allows for time to correct mooring; and (2) it allows maneuvering room for unexpected wave motions during the docking and the undocking of the boating vessel.

In an exemplary embodiment, each of jaws 151 and 153 is preferably formed of 17-4 PH Cond. 1075 material due to this material's enhanced strength and corrosion properties. In an exemplary embodiment, the preferred maximum aperture between jaws 151 and 153 is about 35.625 inches or about 17.813 inches from platform 194's centerline. Additionally, in an exemplary embodiment, engaging rod 54's diameter is preferably about 3.5 inches, thus allowing an approximately plus or minus 16 inch margin of error from platform 194's centerline.

d. Actuating Subassembly.

Figure 15:
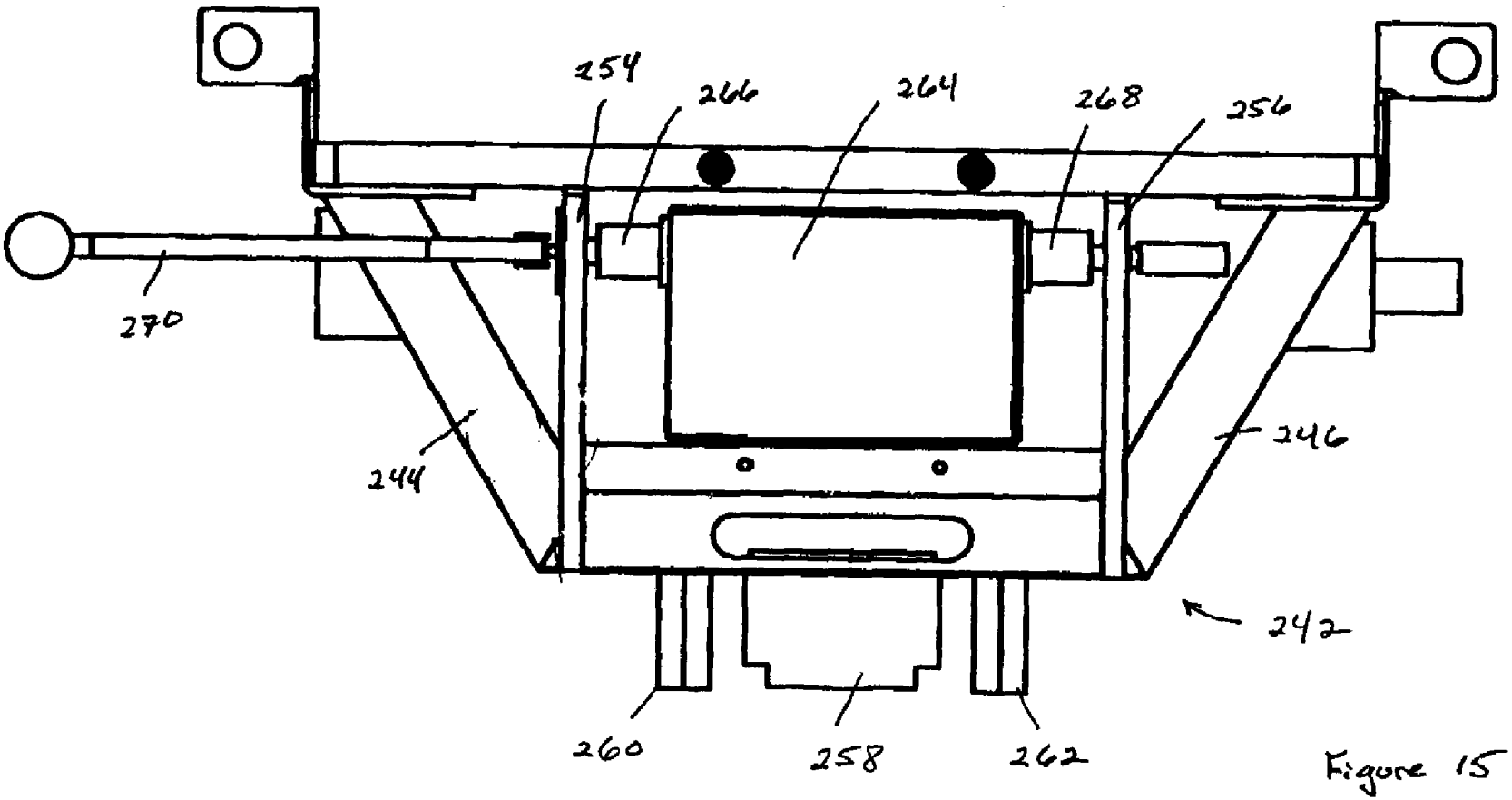
FIG. 15 is a schematic illustrating a profile view of the actuating subassembly depicted in FIG. 14.

As will be more evident from the disclosure provided below, actuating subassembly 108 in conjunction with jaw subassembly 102 assists in the opening and closing of jaws 151 and 153 to secure engaging rod 54 between jaws 151 and 153. Referring to FIGS. 14 and 15, exemplary actuating subassembly 108 comprises a frame 242 comprising legs 244 and 246 attached to a body 248 at an acute angle. Each of legs 244 and 246 is attached to plate 142 of carriage subassembly 104, preferably by welding. Additionally, each of legs 244 and 246 comprises a respective support member 250 and 252 mounted thereto. Providing further structural support to the entire unit, are gussets 254 and 256, which extend from and connect plate 142 to body 248.

Extending from body 248 is a port 258 which receives shaft 206 of plunger component 192. Surrounding port 258 are extensions 260 and 262 which assist in deflecting the forces to which mounting assembly 100 is exposed.

Figure 16:
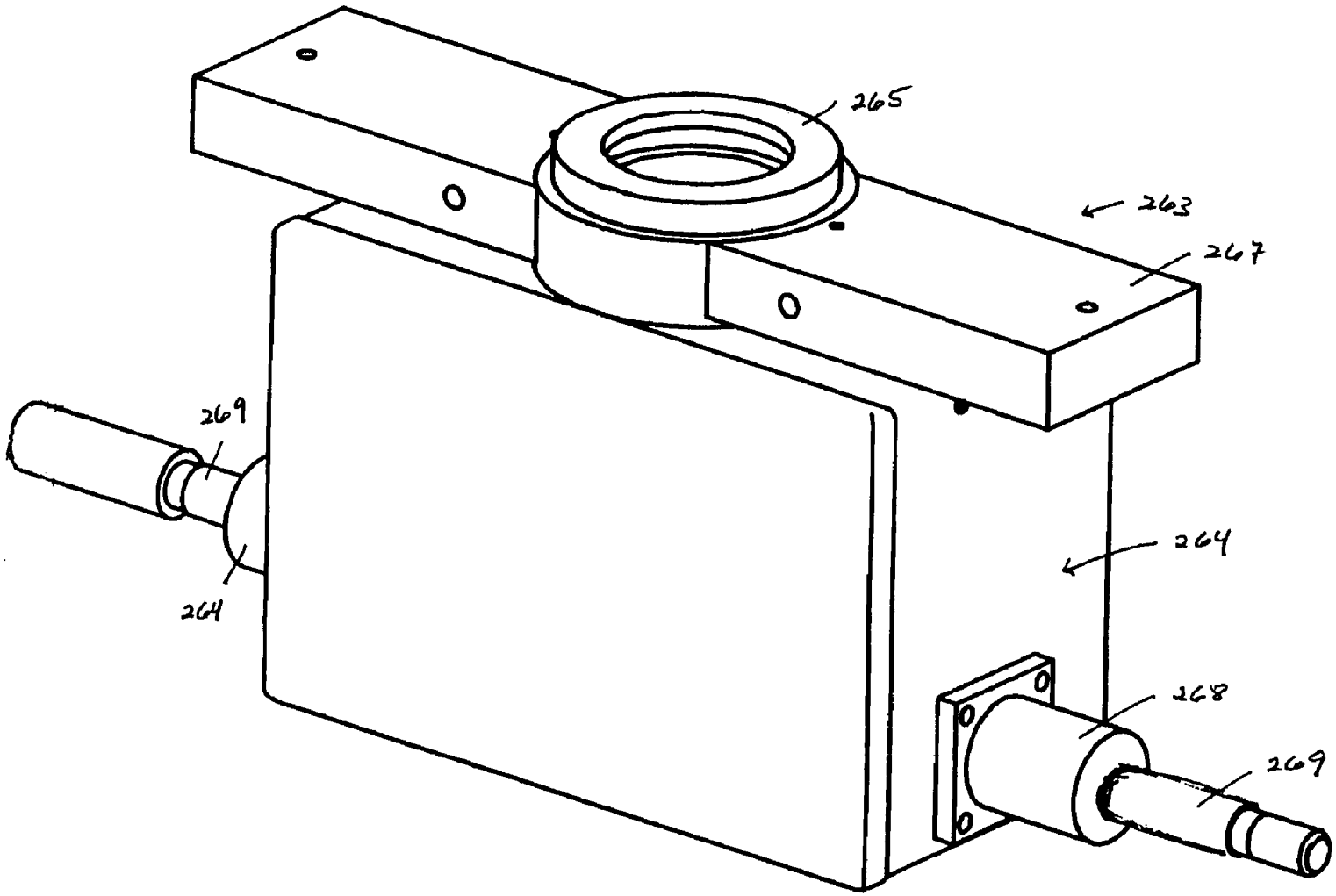
FIG. 16 is a schematic illustrating an elevational side view of an exemplary actuating subassembly.
Figure 17:
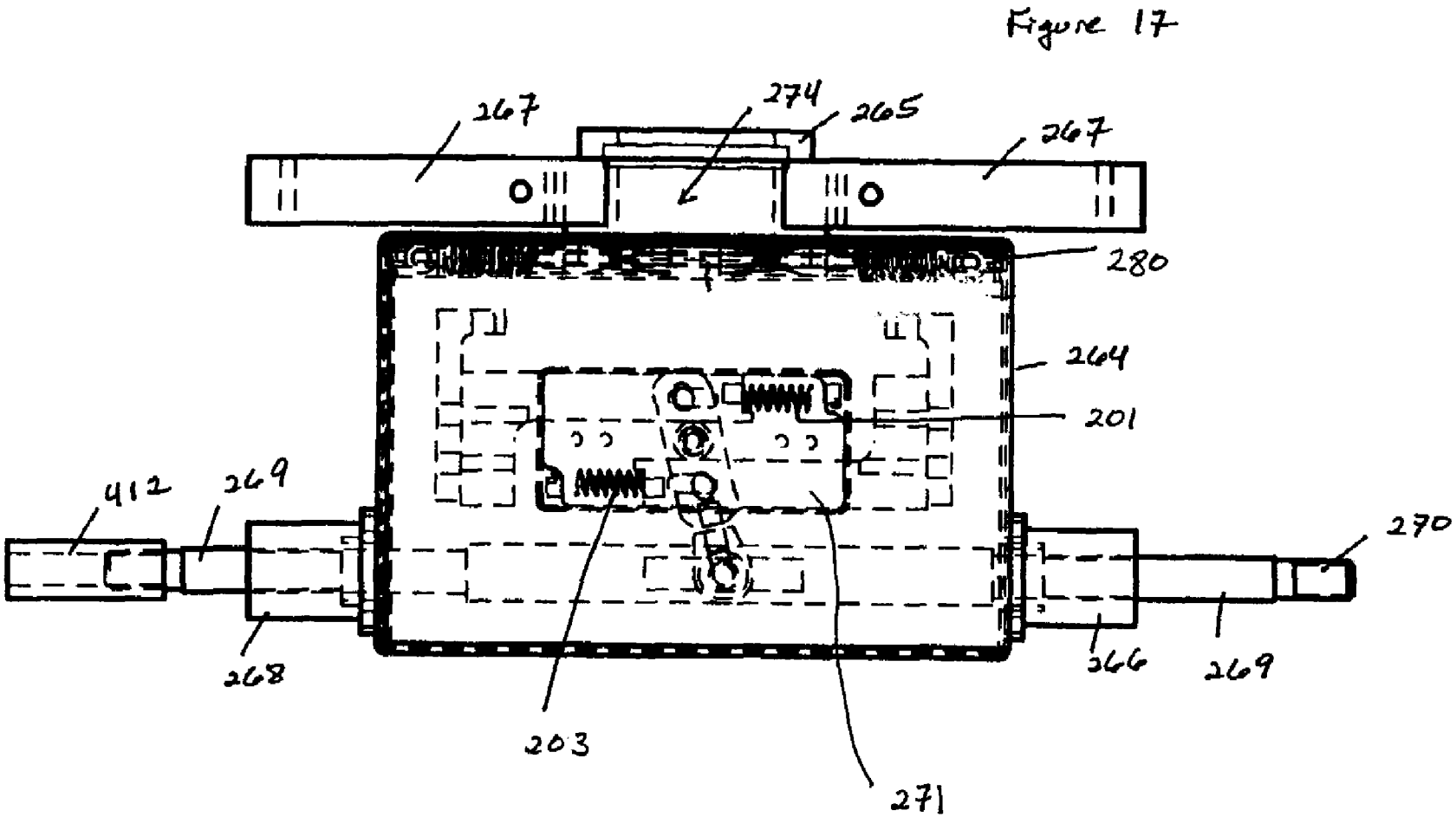
FIGS. 17 and 18 are schematics illustrating an interior view of the actuating subassembly depicted in FIG. 16.
Figure 18:
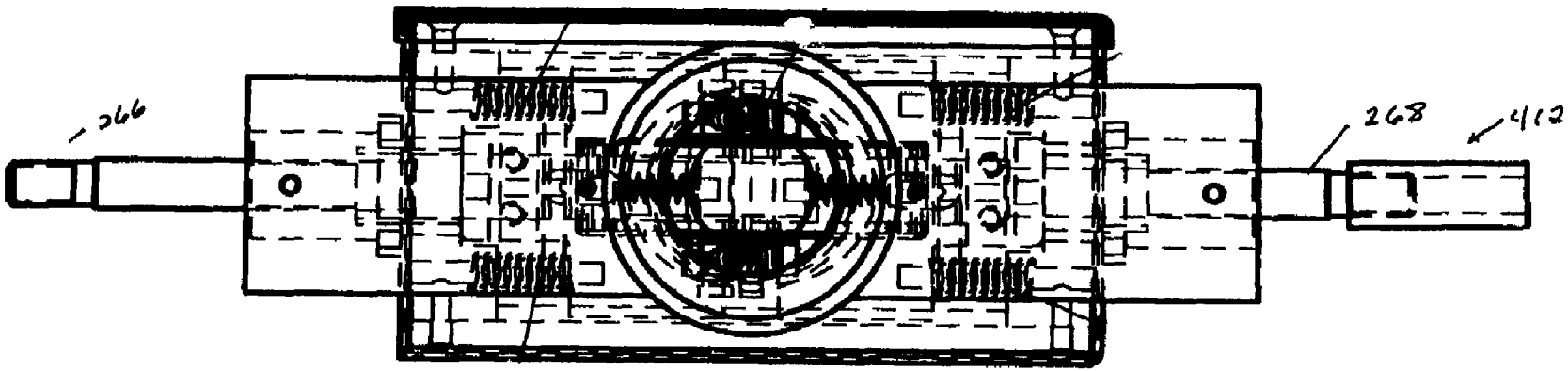
Figure 19:
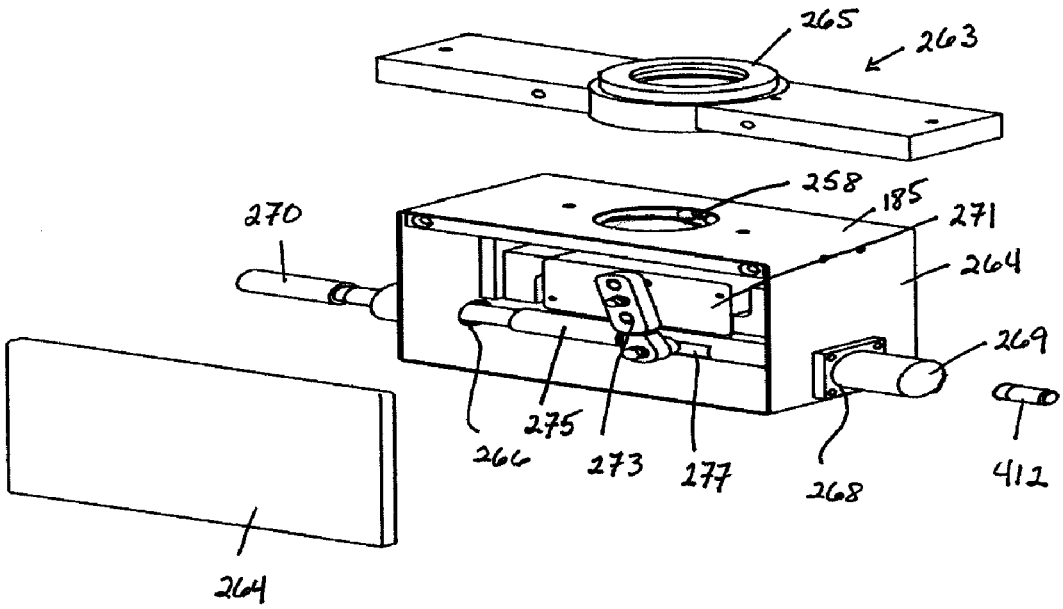
FIG. 19 is a schematic illustrating an exploded view of an exemplary actuating subassembly.
Figure 20:
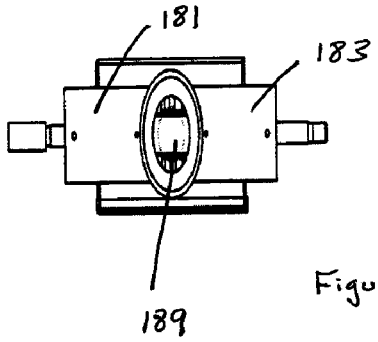
FIG. 20 is a schematic illustrating a top view of an exemplary actuating subassembly.
Figure 21:
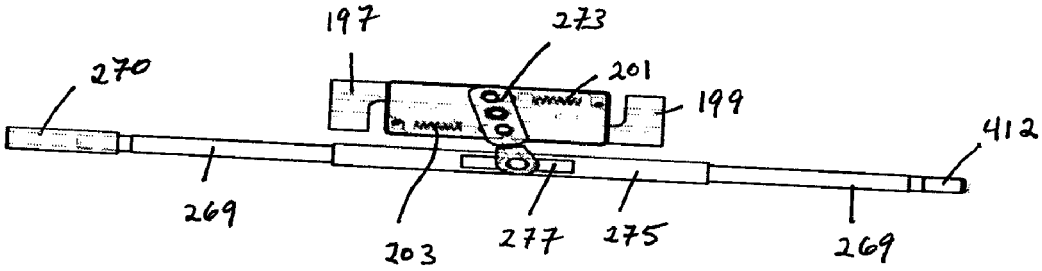
FIG. 21 is a schematic illustrating a longitudinal view of a profile of an exemplary actuating subassembly.
Figure 22:
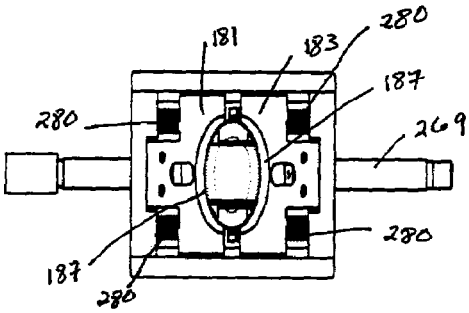
FIGS. 22-25 are schematics illustrating various views of an exemplary actuating subassembly.

Referring to FIGS. 16, 17, and 19, located directly beneath body 248 is an attachment element 263 comprising a port 265 directly aligned with port 258, and a frame 267 which encompasses port 265. Port 258 leads into an interior portion of a case 264, and receives cap 211 of plunger component 192.

Referring to FIGS. 17, 18, and 20-25, actuating subassembly 108 further comprises a plate 181 opposite to a plate 183. Plates 181 and 183 are attached to an underside of a top surface 185 of case 264. Each of plates 181 and 183 comprises a concave side 187, which together create an opening 189. Plates 181 and 183 are spring loaded by a plurality of springs 280. In its resting state, plate 181 is separated from plate 183 and plurality of springs 280 are in a compressed state.

In application, as plunger component 192 and block 219 move towards actuating subassembly 108, as caused, e.g., by pressing engaging rod 54 against platform 194 of plunger component 192, once indentations 108 and 110 around cap 211 come into contact with concave sides 187 of plates 181 and 183, springs 280 decompress and clamp plates 181 and 183 onto indentations 108 and 110, thereby locking plunger component 192 into the actuating subassembly.

Still referring to the Figures, actuating subassembly 108 further comprises a bracket 191 and a bracket 193, wherein bracket 191 is connected to plate 181 and bracket 193 is connected to plate 183. Each of brackets 191 and 193 is connected to a respective bracket 197 and 199 which is located inside case 264. Bracket 197 is connected to a spring 201 and bracket 199 is connected to a spring 203. Additionally, brackets 197 and 199 are both connected to levers, wherein only a single lever 273 depicted on only one side is shown.

A portion of the levers is hingedly attached to an actuating shaft 269. Actuating shaft 269 is disposed through a rod 275 having a slot 277 and another slot formed on an opposite side of rod 275. As actuating shaft 269 is attached to levers, it will move in relation to the stress place on or removed from springs 201 and 203. The edges which form the borders of the slots serve as stop guards thereby limiting the hinged movement of the levers when actuating shaft 269 slides in reaction to forces generated by springs 201 and 203.

Referring to FIG. 19, located on both sides of case 264 are outlets 266 and 268 through which an actuating shaft 269 extends. Attached to one end of actuating shaft 269 is a cable 412, and attached to the opposite end of actuating shaft 269 is a handle 270.

In application, when plates 181 and 183 close, i.e., clamp onto indentations 108 and 110, brackets 191 and 193, which are attached to respective plates 181 and 183 exert a force onto respective brackets 197 and 199 which then assert a force onto respective springs 201 and 203. As will be discussed below, movement of levers 275 then cause movement of cable 412 which is a component of signal indicator assembly 400.

In an exemplary embodiment, handle 270 may be used to initiate the opening of jaws 151 and 153. That is, when plunger component 192 is moved towards actuating subassembly 108, and when indentations 108 and 110 of plunger component 192 makes contact with concave edges 187 of plates 181 and 183, plunger component 192 is locked to actuating subassembly 108. As previously discussed, this locking mechanism affects the energized state of springs 201 and 203. Additionally, as plunger component 192 moves towards actuating subassembly 108, jaws 151 and 153 of jaw subassembly 102 begins to secure engaging rod 54 to mooring assembly 100. Handle 270, which is in communication with springs 201 and 203 via its attachment to actuating shaft 269 may be used to reverse the state of springs 201 and 203, and to thereby expel plunger component 192 from inlet 274 with sufficient force such that gears 184 and 186 move in the opposite direction, thereby causing jaws 151 and 153 to open outwardly, thereby releasing engaging rod 54. In an exemplary embodiment, handle 270 is used in emergency situations to release a boating vessel from the mooring assembly.

The use of cable 412 to assist in opening jaws 151 and 153 will be discussed below with reference to signal indicator assembly 400.

e. Torsion Subassembly.

Referring to FIGS. 31-33, although optional, when used, torsion subassembly 101 is located under flanges 168 and 170 and jaws 151 and 153 of jaw subassembly 102. The purpose of the torsion subassembly is to rotate jaws 151 and 153 at an angled right and left direction. In an exemplary embodiment, torsion subassembly rotates jaws 151 and 153 at about a 25 degree to about a 35 degree downward angle of rotation to accommodate, for example, a boating vessel, wherein the timing of the lateral rotation is directed by the boating vessel's rolling motion. In this manner, then, torsion subassembly 101 redirects jaws 151 and 153 when a boating vessel makes contact with jaws 151 and 153, thereby, reducing the likelihood of damage to the boating vessel, which may otherwise result from such contact. In an exemplary embodiment, when a boating vessel approaches mooring assembly 100 and makes contact with rollers 160 and/or 162, torsion subassembly 101, which is in communication with both flanges 168 and 170 and jaws 151 and 153 of jaw subassembly 102, pivots jaws 151 and 153 via jaws 151 and 153's hinged connection to respective flanges 168 and 170, such that the boating vessel does not ram into jaws 151 and 153.

3. Signal Indicator Assembly.

Referring to FIG. 5, an exemplary signal indicator assembly 400 is preferably installed on floating dock 300. In an exemplary embodiment, it may be approximately 12 feet high; however, the height of signal indicator assembly 400 can be varied and is contingent on specific needs. Signal indicator assembly 400 works in combination with actuating subassembly 108 and with jaw subassembly 102 to primarily serve two purposes: (1) to assist in releasing or opening jaws 151 and 153 from engagement rod 54 when the boating vessel is ready to leave the dock; and (2) to signal when jaws 151 and 153 are securely engaged with engagement rod 54.

Referring to FIGS. 26-29, signal indicator assembly 400 comprises a housing 401, which comprises a port 402. Signal indicator assembly 400 further comprises a signaling member which comprises docked and undocked indicators which signal when the boating vessel is or is not properly moored. Referring to FIGS. 26-29, an exemplary undocked indicator comprises a red safety reflector 404 and an exemplary docked indicator comprises a green safety reflector 406, wherein red safety reflector 404 is in line with a green safety reflector 406 which is inline with a signal indicator spring 414, wherein reflectors 404 and 406 and signal indicator spring 414 are located within housing 401. Port 402 serves as a window whereby one of red and green safety reflectors 404 and 406 is visible.

Red and green safety reflectors 404 and 406 are preferably the most visible part of signal indicator assembly 400. In an exemplary embodiment, the red and green reflectors are 6 inches in diameter and placed at the maximum height of signal indicator assembly 400. Additionally, in an exemplary embodiment, the normal state of signal indicator assembly 400 is such that red safety reflector 404 is visible through port 402; upon successful mooring and subsequent locking of jaw subassembly 102, green safety reflector 406 is visible through port 402. Once green safety reflector 406 is visible through port 401, the loading and unloading of passengers and/or cargo from the boating vessel may commence.

It is herein noted that, although signal indicator assembly 400 has been described as having red and green safety reflectors 404 and 406, it is in no way intended to limit the invention to this particular embodiment. That is, the signal indicator member may comprise any numerous types of indicators, be it visual or auditory, so long as the indicator member signals when the boating vessel is locked to the mooring assembly and when it is unlocked from the mooring assembly. Additionally, although signal indicator assembly 400 is described as purely mechanical in operation, the signal indicator may also incorporate electrical elements.

Signal indicator assembly 400 further comprises a cable 412, which extends from housing 401 to actuating shaft 269 of actuating subassembly 108 such that cable 412 is in communication with springs 201 and 203 of actuating subassembly 108 and with signal indicator spring 414 of signal indicator assembly 400.

Additionally, signal indicator assembly 400 further comprises a release lever 408 enclosed in a safety box 410, wherein safety box 410 is attached to a stand 416, which is attached to housing 401. Though purely optional, safety box 410 prevents the unauthorized release of engaging rod 54 from mooring assembly 100. Release lever 408 is in communication with signal indicator spring 414 via a rod 418 which is used to communicate with a switch member 419. Switch member 419 is in communication with signal indicator spring 414. Additionally, switch member 419 is in communication with cable 412.

As previously stated, signal indicator assembly 400 acts in cooperation with actuating subassembly 108 and jaw subassembly 102: (1) to open and close jaws 151 and 153; and (2) to indicate when the boating vessel is properly moored or unmoored to floating dock 300. Indicator assembly 400 accomplishes this via the following mechanism. As block 219 presses cap 211 through opening 189 formed between plates 181 and 183 of actuating subassembly 108, plates 181 and 183 close or clamp around indentations 108 and 110 via plurality of springs 280. As previously discussed, this clamping affects springs 201 and 203 which results in the movement of lever 273, which in turn moves actuating shaft 269. As cable 412 is attached to actuating shaft 269, cable 412 also moves. As cable 412 moves, it causes switch member 419 to compresses signal indicator spring 414. Such compression of signal indicator spring 414, forces movement of safety reflectors 404 and 406 in an upward direction such that green safety reflector 406 is aligned with port 402. Additionally, through its connectivity to switch member 419, such compression also shifts the position of release lever 408.

Therefore, in the signal indicator assembly 400's energized state, green safety reflector 406 is aligned with port 402 indicating that engaging rod 54, which is located on the boating vessel, is properly engaged with mooring assembly 100. Release lever 408 may then again be shifted, thereby activating switch member 419 via rod 418 to release the mechanical energy stored in signal indicator spring 414. Consequently, signal indicator spring 414 contracts thereby causing the downward shift of safety reflectors 404 and 406 until red safety reflector 404 is visible through port 402. Accordingly, by purely mechanical means, actuating subassembly 108 communicates with signal indicator assembly 400 to indicate when a boating vessel is securely moored, and when it is not.

Additionally, proximate in time to this movement of reflectors 404 and 406, cable 412 communicates with springs 201 and 203 of actuating subassembly 108 via actuating shaft 269, and causes springs 201 and 203 to assert a force against cap 211 such that plunger component 192 is expelled from actuating subassembly 108. This outward movement of plunger component 192 causes gears 184 and 186 to rotate such that jaws 151 and 153 open to release engaging rod 54.

4. Miscellaneous Components.

In addition to the subassemblies described above, the following discusses other components useful in the efficient and safe performance of the express docking system. Referring to FIG. 1, for example, a boating vessel may be equipped with a reflector 600 located on a floor of the boating vessel. Reflector 600 serves as a tool which allows the boating vessel to align itself with mooring assembly 100, and additionally assists in accurate mooring during nighttime operations. Referring to FIG. 5, floating dock 300 may comprise a guidance reflector 304 located on a central portion of a bumper 306, which abuts the top of mooring assembly 100. Guidance reflector 304 serves to guide the boating vessel towards mooring assembly 100 and may work in combination with reflector 600 to align the boating vessel with platform 194 of plunger component 192. That is, by aligning reflector 600 with guidance reflector 304, it can be assured that the boating vessel is properly positioned relative to mooring assembly 100 such that boating vessel can be properly moored without damage to mooring assembly 100. Reflectors 600 and 304 are preferably constructed of industrial or commercial grade reflecting material, and are preferably formed of a low maintenance material(s).

It is additionally noted that floating dock 300 may be equipped with a safety bumpers subassembly. Referring to FIG. 5, in an exemplary embodiment, "rubber" or rubber-like material bumpers 310 are installed onto dock 300 on each side of mooring assembly 100. Bumpers 310 serve as an added safety feature. Bumpers 310 are also preferably positioned such that a boating vessel not equipped with an engaging rod assembly will not collide with jaw subassembly 102 of mooring assembly 100. The need to use bumpers is ultimately determined upon examination of the actual floating dock on which the express docking system is installed. The size of the safety bumpers is variable, and such bumpers preferably comprise vulcanized rubber.

It is further contemplated that the express docking system disclosed herein may further comprise a keypad electrically connected to the mooring assembly. Upon entry of a specific and personal code into the keypad, the boating vessel may be disengaged from the mooring assembly. Accordingly, the keypad serves primarily as a safety feature in allowing only authorized persons from disengaging the boating vessel from the mooring assembly.

B. OPERATION OF THE EXPRESS DOCKING SYSTEM

As previously disclosed herein, the express docking system is designed such that a boating vessel can be moored to a dock by strictly mechanical means comprising a mooring assembly located on a dock and a rod subassembly located on a boating vessel, preferably on an underside of a front end of the boating vessel. In general terms, jaws of a jaw subassembly close around the engaging rod. Once the jaws are locked, a red safety reflector on the actuating subassembly shifts to reveal a green safety reflector thereby confirming that the boating vessel is engaged with and locked to the mooring assembly. Through the interaction of a variety of spring mechanisms, which are redirected either via a handle located on the actuating subassembly or via a release lever located on the signal indicator, the boating vessel can be released from the mooring assembly. The release of the boating vessel from the mooring assembly is reflected by the substitution of the red safety reflector for the green safety reflector.

Referring to the Figures, in an exemplary embodiment, the boating vessel is moored utilizing the express docking system by aligning guidance reflector 600 located on the boating vessel with reflector 304 located on floating dock 300. The margin of error during mooring is plus or minus about 16 inches from the center of platform 194 of plunger component 192. Red safety reflector 404 on signal indicator assembly 400 is visible in port 402 indicating that jaws 151 and 153 are in an open or unlocked position.

As the boating vessel reaches floating dock 300 and begins to push forward against safety bumpers 310, body 56 of engaging rod 54 will roll or rotate, thereby causing the boating vessel to move towards the center of jaws 151 and 153 and towards plunger component 192. Once engaging rod 54 is properly aligned with plunger component 192, body 56 of engaging rod 54 is pressed against platform 194 of plunger component 192. In an exemplary embodiment, platform 194, which is located in the center of jaw subassembly 102, will move inward for about 2.5 to about 3.5 inches until it is locked into position within actuating subassembly 108. The locking mechanism will become active only in about the last 0.5 inch of plunger component 192's inward motion.

Once plunger component 192 travels to the end of about the final 0.5 inch, engaging rod 54 is engaged, jaws 151 and 153 are locked, and the boating vessel is secured to floating dock 300. The release lever is engaged (upward position) and the safety reflector on the floating dock shows green, signifying that it is now safe to load and unload passengers and/or cargo.

It is herein noted that should the engaged boating vessel be exposed to excessive environmental forces, pins 66 and 68 of engaging rod assembly 10 can be removed by such forces, thereby releasing engaging rod 54 from upper and lower receivers 30 and 32. The release of engaging rod 54 allows the boating vessel to move freely with a reduced risk of damage to the mounting, carriage, and mooring assemblies. Additionally, tether 64 maintains the physical communication between engaging rod 54 and rod subassembly 14, thereby preventing the loss of engaging rod 54.

Once it is time to unmoor the boating vessel, the release lever is switched, thereby releasing cap 211 from actuating subassembly 108. Due to the springs installed behind plunger component 192, plunger component 192 moves outwardly away from actuating subassembly 108, which causes jaws 151 and 153 to open while the boating vessel pulls away from dock 300.

C. CONCLUSION

The express docking system of the present invention is designed to: (1) allow a boating vessel to easily and safely engage and lock upon arrival; (2) allow the boating vessel to easily and safely unlock and disengage upon departure; (3) prevent the boating vessel from dislodging itself from the dock in the event the thrust forces are reversed and concurrently allow the boating vessel to disengage from the dock prior to causing any damage; (4) able to withstand forces created by waves and wind once the express docking system and the boating vessel are engaged; (5) allow synchronous movement of the boating vessel and the dock in response to waves, passenger and/or cargo loading/unloading, and the fluctuating tides (the boating vessel and the dock move simultaneously in response to the dynamic forces exerted through the flowing of the water or in the wake of other navigating vessels); (6) safely transfer and dissipate forces from the express docking system to the floating dock; and (7) safely transfer and dissipate forces from the engaging rods on the boating vessel to the frame of the boating vessel.

Additionally, the express docking system disclosed herein provides many benefits and advantages over the prior art in terms of design, operability, and manufacturing. In terms of design, the express docking system is an improvement over the prior art in its physical size, its improved accessibility for maintenance, its simplicity, and in the fact that it is environmentally friendly. In terms of operability, the express docking system comprises a low number of components and further comprises low/non-corrosive material of construction. Additionally, the express docking system is an improvement over the prior art in that it is reliable, rugged, able to better withstand seasonal changes, and has a low operating noise. In terms of manufacturing benefits, the express docking system disclosed herein is scalable.

Additionally, in an exemplary embodiment, the express docking system is designed to withstand loads exerted by the docked boating vessel under the following conditions: (1) maximum wind generated waves: about 10 feet; (2) maximum boating vessel generated waves: about 4 feet; and (3) maximum load: about 30,000 pounds for the jaws, and variable for the release rod.

The express docking system is built to withstand a reasonable degree of environmental factors. Seasonal climate such as spring, summer, and fall, will have negligible or no effect on the operation of the express docking system. High winds do not directly affect the performance of the express docking system unless the boating vessel is moored, in which case, as explained above herein, the mounting subassembly and the carriage subassembly are configured to deal with wave motions and loads caused by the wind and transferred onto the boating vessel and described below.

Furthermore, the express docking system of the present invention takes into account the possibility that ice may build on the jaws and on the rod during the winter months. In an exemplary embodiment, all critical moving parts forming the system, i.e., the pulley and the vertical rods and springs, are preferably placed into water proof casings. This assists in reducing the likelihood of corrosion and in preventing ice build-up. Additionally, the plunger component is equipped with a built-in ice breaker, i.e., the series of teeth 42, that, when coupled with the forward motion of the boating vessel during mooring, will eliminate reasonable amounts of ice. The express docking system disclosed herein allows for a fast, easy and safe way to mechanically moor the boating vessel without adding complicated procedures while keeping same turnover times as conventional mooring systems. Additionally, the express docking system easily captures and secures the boating vessel during the loading and unloading of passengers and/or cargo, and then quickly releases the boating vessel when the boating vessel is ready to depart from the dock. The mooring procedure is simple, and security measures have been included to avoid any damages to the boating vessels or to any other boating vessel approaching the dock. Other advantages and benefits of the present inventing express docking system will be apparent to persons of ordinary skill in the art.

It is intended that any other embodiments of the present invention that result from any changes in application or method of use or operation, method of manufacture, shape, size, or material which are not specified within the detailed written description or illustrations contained herein, yet are considered apparent or obvious to one skilled in the art, are within the scope of the present invention.

What is claimed is:

1. An express docking system comprising:

an engaging rod assembly comprising an engaging rod subassembly attachable to a boating vessel, wherein the engaging rod subassembly comprises an engaging rod in communication with a main frame;

a mooring assembly comprising:

a mounting subassembly attached to a dock;

a carriage subassembly slidably engaged with the mounting subassembly;

an actuating subassembly mounted to the carriage subassembly; and a jaw subassembly comprising a first jaw opposite to a second jaw;

wherein the engaging rod is disposable between the first and second jaws; and a signal indicator assembly comprising a signaling member, wherein the actuating subassembly actuates the dock signaling member to indicate when the boating vessel is secured to the express docking system, and wherein the signaling member comprises a docked indicator in line with an undocked indicator, and further wherein the signaling member is disposed within a housing of the signal indicator assembly, wherein the housing comprises a port, and wherein the docked indicator is visible through the port when the boating vessel is secured to the express docking system and wherein the undocked indicator is visible through the port when the boating vessel is not secured to the express docking system.

2. The express docking system of claim 1, wherein the signal indicator assembly further comprises a signal indicator spring inline with the signaling member, and wherein the actuating subassembly transmits a force to the signal indicator spring to align the docked signal indicator with the port.

3. The express docking system of claim 2, wherein the signal indicator assembly further comprises a release handle, wherein the release handle transmits a force to the signal indicator spring to align the undocked signal indicator with the port.

4. An express docking system comprising:

an engaging rod assembly comprising an engaging rod subassembly attachable to a boating vessel, wherein the engaging rod subassembly comprises an engaging rod in communication with a main frame, wherein the engaging rod is mounted to the frame by a fastening element and attached to the frame by a tether, wherein the fastening element disengages from the engaging rod when the boating vessel is exposed to environmental forces above a threshold level thereby dismounting the engaging rod from the frame; and a mooring assembly comprising:

a mounting subassembly attached to a dock;

a carriage subassembly slidably engaged with the mounting subassembly;

an actuating subassembly mounted to the carriage subassembly; and a jaw subassembly comprising a first jaw opposite to a second jaw;

wherein the engaging rod is disposable between the first and second jaws.

5. The express docking system of claim 4, wherein:

the fastening element comprises a first pin and a second pin;

the main frame of the engaging rod subassembly comprises:

a T-frame supported by an angled frame member and a vertical frame member, wherein the vertical frame member is joined to the angled frame member at an acute angle and is joined to the T-frame at a perpendicular angle;

an upper receiver attached to the T-frame; and a lower receiver attached to at least one of the angled frame member and the vertical frame member, wherein the upper and lower receivers are aligned with each other, and wherein each of the upper and lower receivers comprises a first side wall opposite to a second side wall, and wherein each of the first and second side walls respectively comprises a first hole aligned with a second hole; and the engaging rod comprises a first end which is received by the upper receiver, and a second end which is received by the lower receiver;

wherein the first pin is inserted through the first and second holes of the upper receiver and the second pin is inserted through the first and second holes of the lower receiver to hold the engaging rod to the upper and lower receivers.

6. An express docking system comprising:

an engaging rod assembly comprising an enraging rod subassembly attachable to a boating vessel, wherein the engaging rod subassembly comprises an engaging rod in communication with a main frame;

a mooring assembly comprising:

a mounting subassembly attached to a dock, wherein the mounting subassembly comprises a stop bar located on a top side of the mounting subassembly;

a carriage subassembly slidably engaged with the mounting subassembly, wherein the carriage subassembly comprises:

a plate; and a pulley unit comprising a pulley wheel, a counterweight, and a chord, wherein the chord connects the plate to the counterweight and is looped over the pulley wheel;

wherein the stop bar provides an upper boundary to the plate and the counterweight;

an actuating subassembly mounted to the carriage subassembly; and a jaw subassembly comprising a first jaw opposite to a second jaw;

wherein the engaging rod is disposable between the first and second jaws.

7. An express docking system comprising:

an engaging rod assembly comprising an engaging rod subassembly attachable to a boating vessel, wherein the engaging rod subassembly comprises an engaging rod in communication with a main frame;

a mooring assembly comprising:

a mounting subassembly attached to a dock;

a carriage subassembly slidably engaged with the mounting subassembly;

an actuating subassembly mounted to the carriage subassembly; and a jaw subassembly comprising a first jaw opposite to a second jaw, and further comprising a plunger component in communication with the actuating subassembly, wherein the plunger component comprises a shaft having a first end opposite to a second end, and further wherein the plunger component further comprises a platform attached to the first end of the shaft;

wherein the engaging rod is disposable between the first and second jaws; and further wherein:

the actuating subassembly comprises a plurality of springs and a handle, wherein the plurality of springs is in communication with the handle, and wherein, when the engaging rod presses against the platform of the plunger component, the second end of the shaft compresses the plurality of springs, and wherein, when the handle is shifted, the plurality of springs is decompressed.

8. The express docking system of claim 7, further comprising a signal indicator assembly comprising a cable, wherein the cable is in communication with the plurality of springs of the actuating subassembly.

9. The express docking system of claim 8, wherein the signal indicator assembly further comprises a signaling member in communication with the cable, wherein the signaling member comprises a docked indicator inline with an undocked indicator, and further wherein the signaling member is disposed within a housing of the signal indicator assembly, wherein the housing comprises a port, and wherein the docked indicator is visible through the port when the boating vessel is secured to the express docking system and wherein the undocked indicator is visible through the port when the boating vessel is not secured to the express docking system.

10. An express docking system comprising:

an engaging rod assembly comprising an engaging rod subassembly attachable to a boating vessel, wherein the engaging rod subassembly comprises an engaging rod in communication with a main frame;

a mooring assembly comprising:

a mounting subassembly attached to a dock;

a carriage subassembly slidably engaged with the mounting subassembly;

an actuating subassembly mounted to the carriage subassembly; and a jaw subassembly comprising a first jaw opposite to a second jaw; and further comprising a plunger component in communication with the actuating subassembly, wherein the plunger component comprises a shaft having a first end opposite to a second end, and further wherein the plunger component further comprises a platform attached to the first end of the shaft;

wherein the engaging rod is disposable between the first and second jaws;

the plunger component further comprises a first lateral extension element and a second lateral extension element, wherein each of first and second lateral extension elements are attached to opposite sides of the shaft, and wherein each of the first and second lateral extension elements comprises a series of ridges; and wherein the jaw subassembly further comprises:

a first gear and a second gear each comprising an outer edge having a series of ridges, wherein the ridges of the first gear are in communication with the series of ridges of the first lateral extension element and the ridges of the second gear are in communication with the series of ridges of the second lateral extension element; and a first flange and a second flange each comprising a ridged upper lip and a ridged lower lip, wherein the ridged lower lip is joined to the ridged upper lip at an acute angle, and wherein the ridged upper and lower lips of the first flange are in communication with the first gear, and the ridged upper and lower lips of the second flange are in communication with the second gear, and wherein the first jaw is attached to the first flange, and the second jaw is attached to the second flange.

11. A method for docking and undocking a boating vessel comprising:

applying a force from an engaging rod located on a boating vessel onto a plunger component, and thereby moving the plunger component towards an actuating subassembly;

securing the engaging rod between a pair of jaws comprising:

engaging grooves located on a first lateral extension element with grooves located on a first gear, and engaging grooves located on a first flange with the grooves of the first gear, wherein a first jaw of the pair of jaws is attached to the first flange; and engaging grooves located on a second lateral extension element with grooves located on a second gear, and engaging grooves located on a second flange with the grooves of the second gear, wherein a second jaw of the pair of jaws is attached to the second flange;

wherein the first and second lateral extension elements are located on the plunger component, and move in association with the plunger component; and locking the plunger component into the actuating subassembly.

12. The method of claim 11, wherein the plunger component comprises a platform disposed atop a shaft, and wherein the actuating subassembly comprises a casing having an inlet which leads to a plurality of springs located around a hold contained within the casing, and wherein locking the plunger component into the actuating subassembly comprises inserting the shaft through the inlet and fixing an end of the shaft to the hold.

13. The method of claim 12, further comprising transmitting a signal via a signal indicator subassembly that the plunger component is locked into the actuating subassembly.

14. The method of claim 13, wherein:

the signal indicator subassembly comprises:

a cable in communication with the plurality of springs located around the hold;

a signaling member comprising a docked indicator inline with an undocked indicator, wherein the signaling member is located within a housing comprising a port;

a signal indicator spring inline with the docked and undocked indicators and in communication with the cable; and wherein transmitting the signal that the plunger component is locked into the actuating subassembly comprises:

compressing the plurality of springs located around the hold;

transmitting a force to the cable, where the force is transferred to the signal indicator spring and compresses the signal indicator spring, and wherein a second force generated by the compressed signal indicator spring aligns the docked indicator with the port.

15. The method of claim 14, further comprising unsecuring the engaging rod from between the pair of jaws.

16. The method of claim 15, wherein the actuating subassembly comprises a handle in communication with the plurality of springs, and wherein unsecuring the engaging rod from between the pair of jaws comprises shifting a position of the handle such that the handle generates a force used to decompress the plurality of springs and to force the end of the shaft out of the hold; and further wherein such movement of the plunger component causes the first and second gears to move in a direction which moves the first jaw away from the second jaw.

17. The method of claim 15, wherein:

the signal indicator assembly further comprises a release handle in communication with the signal indicator spring; and wherein the method further comprises transmitting a signal via the signal indicator subassembly that the plunger component is unlocked from the actuating subassembly, wherein transmitting the signal comprises:

shifting the position of the release handle to uncompress the signal indicator spring thereby generating a force that aligns the undocked indicator with the port; and wherein unsecuring the engaging rod from between the pair of jaws comprises:

transmitting the force generated from the uncompressed signal indicator spring to the cable to create another force used to uncompress the plurality of springs which generates a force used to expel the end of the shaft out of the hold; and further wherein such expulsion creates a movement of the plunger component which causes the first and second gears to move in a direction which moves the first jaw away from the second jaw.

* * * * *